US010927856B2

(12) United States Patent
Imam et al.

(10) Patent No.: US 10,927,856 B2
(45) Date of Patent: Feb. 23, 2021

(54) PUMP-CONTROLLED HYDRAULIC CIRCUITS FOR OPERATING A DIFFERENTIAL HYDRAULIC ACTUATOR

(71) Applicant: University of Manitoba, Winnipeg (CA)

(72) Inventors: Ahmed A. Imam, Zagazig (EG); Nariman Sepehri, Winnipeg (CA)

(73) Assignee: University of Manitoba, Winnipeg (CA)

( * ) Notice: Subject to any disclaimer, the term of this patent is extended or adjusted under 35 U.S.C. 154(b) by 134 days.

(21) Appl. No.: 15/815,181

(22) Filed: Nov. 16, 2017

(65) Prior Publication Data

US 2018/0266447 A1 Sep. 20, 2018

Related U.S. Application Data

(60) Provisional application No. 62/423,286, filed on Nov. 17, 2016.

(51) Int. Cl.

| | |
|---|---|
| ***F15B 7/00*** | (2006.01) |
| ***F15B 7/10*** | (2006.01) |
| *F15B 21/14* | (2006.01) |

(52) U.S. Cl.

CPC ..... *F15B 7/006* (2013.01); *F15B 7/10* (2013.01); *F15B 21/14* (2013.01); (Continued)

(58) Field of Classification Search

CPC .. F15B 7/006; F15B 7/10; F15B 2211/20561; F15B 2211/27; F15B 2211/613; F15B 2211/785

See application file for complete search history.

(56) References Cited

U.S. PATENT DOCUMENTS 7,543,449 B2 * 6/2009 Ivantysynova ..... F15B 7/006 60/464

8,966,892 B2 * 3/2015 Opdenbosch ..... F15B 11/08 60/420

(Continued)

FOREIGN PATENT DOCUMENTS

WO WO-2013112109 A1 * 8/2013

WO WO-2014045672 A1 * 3/2014 ..... E02F 9/2292

*Primary Examiner* — Abiy Teka

*Assistant Examiner* — Michael Quandt

(74) *Attorney, Agent, or Firm* — Kyle R Satterthwaite; Michael R Williams; Ade & Company Inc.

(57) ABSTRACT

Pump-controlled hydraulic circuits are more efficient than valve-controlled circuits, as they eliminate the energy losses due to flow throttling in valves and require less cooling effort. Presently existing pump-controlled solutions for single rod cylinders encounter an undesirable performance during certain operating conditions. Novel circuit designs employ use of different charge pressures on a pair of pilot-operated charging-control valves or different piston areas and/or spring constants on a shuttle-type charging control valve to shift a critical loading region in a load-force/actuator-velocity plane to a lower load force range, thereby reducing the undesired oscillations experienced in the response of the typical critical loading region. One or more specialized valves are controlled by fluid pressures to provide throttling in the circuit only within the critical loading region, thereby reducing the oscillatory amplitude while avoiding throttling-based energy losses outside the critical region over the majority of the circuit's operational overall operating area.

13 Claims, 19 Drawing Sheets

(52) U.S. Cl.
CPC ..... *F15B 2211/20553* (2013.01); *F15B 2211/20561* (2013.01); *F15B 2211/20569* (2013.01); *F15B 2211/27* (2013.01); *F15B 2211/30515* (2013.01); *F15B 2211/355* (2013.01); *F15B 2211/40507* (2013.01); *F15B 2211/40576* (2013.01); *F15B 2211/5059* (2013.01); *F15B 2211/613* (2013.01); *F15B 2211/625* (2013.01); *F15B 2211/6658* (2013.01); *F15B 2211/7053* (2013.01); *F15B 2211/761* (2013.01); *F15B 2211/785* (2013.01); *F15B 2211/8613* (2013.01); *F15B 2211/8616* (2013.01); *F15B 2211/88* (2013.01)

(56) References Cited

U.S. PATENT DOCUMENTS

| | | | | |
|---|---|---|---|---|
| 9,523,184 | B2 * | 12/2016 | Kim | F15B 7/006 |
| 9,829,013 | B2 * | 11/2017 | Cho | F15B 1/027 |
| 9,845,813 | B2 * | 12/2017 | Shimizu | E02F 9/2292 |
| 2016/0201694 | A1 * | 7/2016 | Vacca | F15B 7/006 60/476 |

* cited by examiner

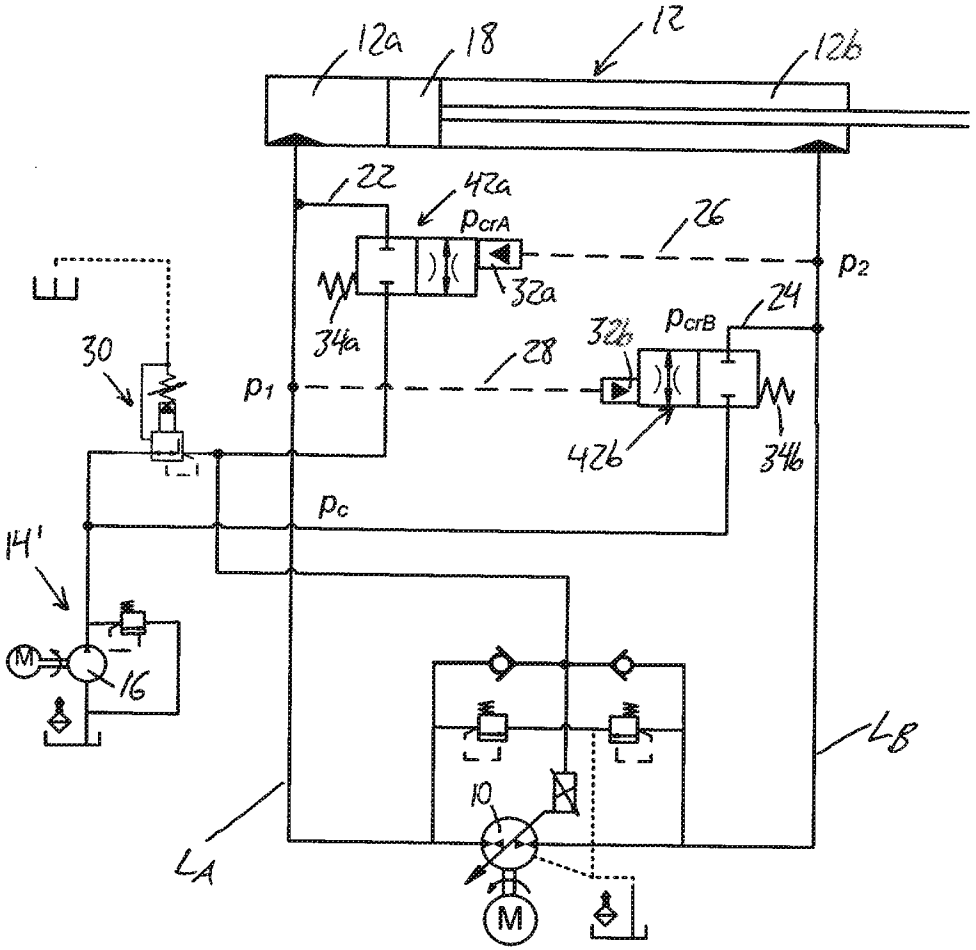
FIG.9
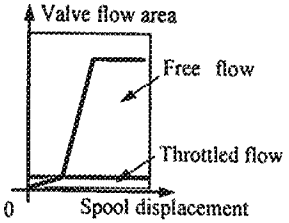

(a) (b)

(a) (b)

PUMP-CONTROLLED HYDRAULIC CIRCUITS FOR OPERATING A DIFFERENTIAL HYDRAULIC ACTUATOR

CROSS-REFERENCE TO RELATED APPLICATIONS

This application claims benefit of U.S. Provisional App. No. 62/423,286, filed Nov. 17, 2016, the entirety of which is incorporated herein by reference.

FIELD OF THE INVENTION

The present invention relates generally to hydraulic circuits for controlling a differential actuator, and more particularly to pump-based control of such hydraulic circuits.

BACKGROUND

It has been seen that pump-controlled hydraulic circuits have better efficiency compared to valve-controlled circuits. Cleasby and Plummer [1] reported that their pump-controlled circuit consumed only 11% of energy required by a valve-controlled circuit to perform the same task. On the other hand, valve-controlled circuits, to date, exhibit better dynamic performance [2]. However, machine efficiency is becoming a real concern from economic and environmental points of view, especially in mobile hydraulic industry. Throttling losses in valves represent one of the main energy losses in hydraulic circuits presently used in these machines. To reduce throttling losses, load-sensing technologies have been extensively used in mobile industry [3, 4]. Nevertheless, throttling losses still represent 35% of the energy received by a hydraulic system equipped with load-sensing technology in a typical excavating machine [5]. Large energy savings can be obtained by eliminating/reducing metering losses.

Pump-controlled circuits have been well-developed for double rod cylinders [6,7,8]. For example, the new Airbus airliner aircraft, A380 is equipped with this technology [9]. However, single rod cylinders are used in at least 80% of the electro-hydraulic applications [8]. Many initiatives to develop pump-controlled circuits for single-rod cylinders have also been done [1, 6, 10, 11, 12, 13, 14, 15, 16]. Rahmfeld and Ivantysynova [11] introduced a circuit that comprises a variable displacement piston pump and two pilot operated check valves (POCVs) to compensate for the differential flow in single rod hydraulic cylinders. Hippalgaonkar and Ivantysynova [17] and Grabbel and Ivantysynova [18] applied the circuit in a concrete pump truck, a loader, and a multi-joint manipulator. Williamson et al. [19, 20] studied the performance of a skid-steer loader equipped with this circuit. They reported boom velocity oscillations and pump mode of operation switching during lowering light loads at high speeds. Williamson et al, [21] and Wang et al. [12] further showed that the circuit with two pilot operated check valves (POCVs) is unstable at low loading operations. To deal with this problem, Williamson and Ivantysynova [20] proposed a feedforward controller. Their solution was tested on (limited to) custom-build pumps with fast rise time of 80 ms [22]. Commonly used pumps in the market [23] possess rise time of about 500 ms. Wang et al. [12] replaced the POCVs with a closed-center 3-way, 3-position shuttle valve for flow compensation. They added two electrically-activated regulating valves to dampen the undesirable oscillations through leakage control. This approach, however, requires additional control effort and extra sensors that increases system cost and complexity. Calishan et al. [13] simplified the previous design [12] by utilizing an open-center shuttle valve to incorporate the leakage control together with flow compensation. The design required less control effort and showed stable performance. However, they reported that their solution works best under certain actuator velocities. Also their experimental work was limited to low loading conditions and lacked the effect of mass inertia. Jalayeri et al. [6, 24], and Altare and Vacca [15] introduced the idea of regulating the load motion with the help of counterbalance valves, which belong to throttling elements. To compensate for the differential flow Jalayeri et al. [24] used an On/Off solenoid valve and a check valve while Altare and Vacca [15] utilized a special form of shuttle valve, which they called dual pressure valve. Both designs are more energy efficient than the to conventional valve-controlled alternatives and accurate enough for many industrial applications. Nevertheless, these designs cannot regenerate energy [24]. From the above discussion it is seen that in spite of the large amount of studies on the topic, the use of throttle-less actuation technology for single rod cylinders has not been fully explored, compared to valve-controlled actuation, in terms of dynamic performance [19, 25].

FIG. 1 shows a commonly used circuit that utilizes two pilot-operated check valves (POCVs) for motion control of a single rod hydraulic actuator, A reversible or bidirectional hydraulic pump, 10, defines the main power source for the single-rod differential linear hydraulic actuator 12. The opposite first and second sides of the pump 10 are respectively connected to the extension and retraction sides of the actuator by first main fluid transmission line $L_A$ and second main fluid transmission line $L_B$. A hydraulic charging system 14 features a unidirectional hydraulic pump 16 and relief valve for supplying charging fluid to the first and second main fluid lines to compensate for differential flow on opposing sides of the differential hydraulic actuator due to the larger area of the actuator's piston 18 on the capped extension side 12*a* of the actuator than on the rod-accommodating retraction side 12*b* of the actuator. A cross-pressure line connecting between the main fluid lines $L_A$, $L_B$ has a singular connection to the charging system 14, which features an accumulator 20 to boost the charge pump and supplement flow to the circuit when needed. The cross-pressure line is made up of a first charging line 22 connecting the charging system to the first main fluid line $L_A$, and a second charging line 24 connecting the charging system to the second main fluid line $L_B$. The first charging line 22 features a first pilot-operated check valve $POCV_A$, and the second charging line 24 features a second pilot-operated check valve $POCV_B$. Pilot lines 26, 28 respectively connected to the two POCVs are pressurized through the cross pressure line of the circuit so that fluid from second main fluid $L_B$ provides pilot pressure to $POCV_A$ through the first pilot line 26, and fluid from first main fluid line $L_A$ provides pilot pressure to $POCV_B$ through the second pilot line 28.

Referring to FIG. 1, pressure difference across the pump is defined as $P=p_a-p_b$, where $p_a$ and $p_b$ are pressures at the pump ports. Q is the flow rate through the pump, it is positive when the hydraulic oil flows from port b to port a. Ports a and b of the pump are also referred to herein as the first and second sides of the pump, respectively. The circuit works in pumping mode if P and Q possess the same sign. Otherwise, it works in motoring mode. From the actuator perspective when the cylinder velocity, $v_a$, and external force, $F_L$, have the same sign, (for example, the cylinder extends against the load) the actuator works in resistive mode. Otherwise it works in assistive mode.

FIG. 1 shows the state of the circuit during a load-resisting extension of the actuator in a pump-mode of the reversible pump 10 (see Quadrant 1, FIG. 2) where the velocity of the actuator $v_a$ opposes the load force $F_L$. Once pressure in the first main fluid line $L_A$ is sufficiently high to actuate the pilot of $POCV_B$ through the second pilot line 28, $POCV_B$ opens to enable charging fluid from the charging system to be pumped into second main fluid line $L_B$ to augment the fluid flowing out of the retraction side 12*b* of the actuator back to the pump 10, which would otherwise be insufficient due to the higher rate of flow demanded from the first side of the pump by the extension side 12*a* of the actuator. Likewise, during a load-assisting extension of the actuator in a motoring-mode of the pump (see Quadrant 2, FIG. 2), opening of $POCV_A$ through the first pilot line 26 by sufficiently high pressure in second main fluid line $L_B$ enables charging fluid from the charging system 14 to be pumped into first main fluid line $L_A$ to augment the fluid flowing into the extension side 12*a* of the actuator, which would otherwise be insufficient due to the lower flow coming out of the retraction side 12*b* of the actuator 12 and flowing through the pump. Driven by the load on the actuator during this, this flow from the retraction side of the actuator causes the pump to operate as a motor, whereby such motoring can be used to recoup energy from the hydraulic system. This recapture of energy that would otherwise be wasted is referred to as regeneration.

Opening of $POCV_B$ also occurs in response to sufficient piloting pressure from first main fluid line $L_A$ during load-assisting retraction of the actuator in another motoring mode of the reversible pump 10 (see Quadrant 4, FIG. 2). Here, this opening of $POCV_B$ allows part of the fluid flow from the second side of the pump to the retraction side 12*b* of the actuator to be redirected out of the main circuit to the charging system 14, as such drainage from the main circuit is required due to the greater flow coming out of the extension side of the actuator under the effect of the load force than can be accommodated on the opposing retraction side. Likewise, opening of $POCV_A$ also occurs in response to sufficient piloting pressure from second main fluid line $L_b$ during load-resisting retraction of the actuator in a pumping-mode of the reversible pump 10 (see Quadrant 3, FIG. 2). This allows part of the fluid flow to the first side of the pump from the extension side of the actuator to be redirected and drained to the charging system, as is required to once again accommodate the differential flow across the actuator, in which the retraction side of the actuator cannot accommodate the larger flow being produced out of the extension side thereof due to the differential area between the two faces of the actuator piston 18.

From the two preceding paragraphs, it can be seen how the POVCs accommodate the differential flow to and from the actuator in the four quadrants of operation.

Considering extension the actuator against the resistive external load, as shown in FIG. 1, the pump delivers flow Q in clockwise direction to the capped extension side of the cylinder through first main transmission line $L_A$. As the pressure in line $L_A$ builds up, it opens the cross pilot-operated check valve, $POCV_B$, which allows flow, $Q_2$, to compensate for the cylinder differential flow. In this case, the main pump works in pumping mode. Clearly, motion will not begin unless the POCVs are in the proper working positions to compensate for the differential flow of the cylinder and avoid hydraulic lock. Otherwise, poor responses may be experienced in certain regions of operation, as outlined below.

The main dynamics of the actuator can be described as follows:

$$m\dot{v}_a = (p_A A_A - p_B A_B) - F_f - F_L \tag{1}$$

$$\dot{p}_A = \frac{K_{oil}}{V_A}(Q_A - A_A v_a) \tag{2}$$

$$\dot{p}_B = \frac{K_{oil}}{V_B}(-Q_B + A_B v_a) \tag{3}$$

where m represents the equivalent moving mass. Pressures at actuator ports are denoted by $p_A$ and $p_B$. $Q_A$ and $Q_B$ are the flow rates to and from the actuator ports. Piston effective areas are represented by $A_A$ and $A_B$. $K_{oil}$ is the oil bulk modulus. The oil volumes at each side of the circuit are represented by $V_A$ and $V_B$; they change with cylinder displacement Friction force, $F_f$, is assumed to be the sum of the Stribeck, Coulomb and viscus friction components [26]:

$$F_f = F_C(1+(K_b-1)e^{-c_v|v_a|})\mathrm{sgn}(v_a)+f_v v_a \tag{4}$$

$$F_C = F_{Pr}+f_c(P_A+P_B) \tag{5}$$

where $F_C$ represents the Coulomb friction; $K_b$ and $c_v$ denote breakaway friction force increase and velocity transition coefficients, respectively; $f_v$ and $f_c$ are the viscous and Coulomb friction coefficients, respectively. $F_{pr}$ represents the preload force generated due to seal deformation inside the cylinder during installation. In Eq. (5), Coulomb friction $F_C$ is assumed to be the summation of the seals preloading force, caused by the seal pre-squeezing during assembly, and the force related to the seal squeezing due to the operational pressure effect. It is clear from Eq. (5) that the Coulomb friction increases as the load and corresponding actuator pressures increase.

Amongst various types of POCVs, the commonly-used one uses the pilot line pressure referenced to charge pressure $p_c$ [12]. This type is preferred in the pump-controlled circuits because it provides less interference margin during operation of both valves in the circuit, which supports the system stability [12]. POCVs are normally closed and can be opened in two ways. They can be opened through the pilot line pressure as been presented in Eq. (6), or through the charge line pressure described by Eq. (7) [22, 27]. The two cracking conditions are represented, for $POCV_B$, by the following equations:

$$K_p(p_1-p_c)-(p_2-p_c)\geq p_{cr} \tag{6}$$

$$p_c-p_2\geq p_{cr} \tag{7}$$

where $K_p$ and $p_{cr}$ are the POCV pilot ratio and cracking pressure, respectively. The operation of POCVs is mainly controlled by the pilot pressures $p_1$ and $p_2$, while actuator motion is monitored by pressures $p_A$ and $p_B$. The differences between $p_1$ and $p_A$ and $p_2$ and $p_B$ is due to the losses in the transmission lines. This pressure drop is calculated using the lumped resistance model as follows [21]:

$$\Delta p = C_{dt}q + C_{dl}q^2 \tag{8}$$

where q is the flow in a transmission line, and $C_{dt}$ and $C_{dl}$ represent the combined viscous friction in transmission line and local drag coefficients, respectively.

In normal operation only one of the POCVs is expected to open while the other is closed. However, interference in operation is expected when the two activating pressures $p_1$ and $p_2$ are close to each other [12]. This undesirable interference shows up in three ways: either both valves are closed or both are open or they alternatively open and close. These conditions result in low performance [20].

Wang et al. [12] identified these conditions as operating the circuit around the critical load, $F_{cr}$. Critical load was identified as the actuating force when pressure at both chambers of the actuator equals to the charge pressure. Calishan et al. [13] further specified two load limits ($F_{L1}$ and $F_{L2}$) for this zone in a load-velocity ($F_L$–$v_a$) plane, as shown in FIG. 2. The values of these limits depend on the circuit operational pressures and the actuator effective areas.

FIG. 3 shows more elaborated and detailed representation of operation and undesirable performance zones of the prior art shown in FIG. 2 for the circuit in FIG. 1. The width of the critical zone in circuits with the POCVs (difference between $F_{L10}$ and $F_{L20}$ and $F_{L30}$ and $F_{L40}$ in FIG. 3) at zero velocity depends on the cracking pressures of the POCVs and actuator piston areas. Let the force $F_{CV}$ be defined as the equivalent force on the actuator to the pressure required to open the corresponding POCV. Note that equivalent force to the pressure needed to open $POCV_A$, $F_{CVA}=p_{cr}A_A$, is higher than that needed to open $POCV_B$, $F_{CVB}=p_{cr}A_B$. In pumping mode, the pump generates the required cracking pressure $p_{cr}$ to guarantee proper configurations of POCVs. However, in the motoring mode, the external load works to create this cracking pressure.

To study the effect of the friction force components on the shape of the critical zones, we rearrange the actuator equation of motion (ignoring the inertial term and frictional Stribeck component), $$F_L=F_{cr}-F_C\cdot\mathrm{sgn}(v_a)-f_v v_a \tag{9}$$

Since friction force acts against the actuator velocity, the above equation shows that friction force affects the critical zone shape differently in the upper and lower sections of the $F_L$-$v_a$ plane. As seen in FIG. 3, during positive velocity, Coulomb friction component shifts the critical zone to the left while viscous friction bends further it to the left with an angle related to the viscous friction coefficient. These effects are reversed for negative velocities.

Built upon the above analysis, FIG. 3 shows the different limits describing the undesirable performance regions. Regions 1, 2, 3 and 4 in FIG. 3 represent the good performance areas while the performance deterioration occurs in regions 5 and 6. Mathematical representation of the different limit lines can be shown as follows:

$$F_{L1}=F_{cr}-F_f \tag{10}$$

$$F_{L2}=F_{cr}-F_f-F_{CVA} \tag{11}$$

$$F_{L3}=F_{cr}+F_f \tag{12}$$

$$F_{L4}=F_{cr}+F_f+F_{CVB} \tag{13}$$

where at zero velocity we have, $F_{L10}=F_{cr0}-F_C$, $F_{L20}=F_{cr0}-F_C-F_{CVA}$, $F_{L30}=F_{cr0}+F_C$, and $F_{L40}=F_{cr0}+F_C+F_{CVB}$ With reference to FIG. 3, critical region or zone 5 represents pump mode of operation switching (motoring to pumping and vice versa) during actuator extension. Pressures at both sides of the circuit are almost equal and less than the charge pressure which keeps both POCVs open. In this case, charge pump supplies both sides of the circuit with hydraulic flow and the actuator velocity is not fully controllable. Critical region (zone) 6 represents pump mode of operation switching (motoring to pumping and vice versa) during actuator retraction. Pressures at both sides of the circuit are almost equal and higher than the charge pressure and both valves, initially, are critically closed, meaning that the opening and closing forces are nearly the same, and so a minimal increase in either will change the valve state. Opening $POCV_B$ supports motoring mode while motion decelerates due to less assistive load. On the other hand opening $POCV_A$ supports pumping mode and motion acceleration. Consequently, pump mode of operation and POCVs configuration keep switching and pressure and velocity oscillates.

Accordingly, there is a desire for new hydraulic circuit designs and control methods for mitigating these performance issues with the prior circuit designs for pump-controlled operation of differential linear actuators.

SUMMARY OF THE INVENTION

According to a first aspect of the invention, there is provided a pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator;

a first charging line connecting the charging circuit to the first main fluid line;

a second charging line connecting the charging circuit to the second main fluid line;

a set of one or more valves comprising at least one charging-control valve operably installed in the first and/or second charging lines and operable to switch between at least a first charging fluid supply/release state enabling flow through the first circuit-charging line between the first main fluid line and the charging circuit, and a second charging fluid supply/release state enabling flow through the second circuit-charging line between the second main fluid line and the charging circuit, thereby enabling supply and release of the charging fluid to the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein the set of one or more valves includes at least one pilot-operated critical zone shifting valve configured to shift a critical loading zone in the fourth load-assisted actuator-extension quadrant of the four quadrant operation to a lower loading range, whereby oscillation amplitude in the critical loading zone is reduced due to lower loading values in the lower loading range of the shifted critical loading zone.

According to a second aspect of the invention, there is provided a pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator;

a first charging line connecting the charging circuit to the first main fluid line;

a second charging line connecting the charging circuit to the second main fluid line;

a set of one or more valves comprising at least one charging-control valve operably installed in the first and/or second charging lines and operable to switch between at least a first charging fluid supply/release state enabling flow through the first circuit-charging line between the first main fluid line and the charging circuit, and a second charging fluid supply/release state enabling flow through the second circuit-charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant wherein the set of one or more valves includes at least one pilot-operated vibration-damping valve configured to throttle flow in the hydraulic circuit in a critical loading zone of the four-quadrant mode of operation, while allowing unthrottled flow in the hydraulic circuit outside the critical loading zone.

The at least one charging-control valve may have a first valve-actuating input operable to place the at least one valve charging-control in the first charging fluid supply/release state and connected to one of the main fluid lines for pressure-based operation of said valve-controlling first input by fluid from said one of the main lines, and a second valve-actuating input operable to put the at least one charging-control valve in the second charging fluid supply/release state and connected to the other of the main fluid lines for pressure-based operation of said valve-controlling second input by fluid from said other of the main fluid lines, said first and second valve-controlling inputs each being unique from one another in at least one characteristic.

In such instance, the first and second valve-actuating inputs may be characterized from one another by at least one of a pilot-input piston area used to drive movement of the at least one charging-control valve into the respective charging fluid supply/release state, a spring stiffness used to resist movement of the valve into the respective charging fluid supply/release state, and a charging pressure connected to the respective one of the main fluid lines by operation of the input.

The charging system may have two different outlets respectively providing higher and lower pressure supplies of charging fluid and the first and second charging lines are connected to the two different outlets of the charging system.

In such instance, a higher pressure one of said two different outlets of the charging system may be connected to the second circuit-charging line to connect the higher pressure supply of charging fluid to the second main fluid line in the second charging fluid supply/release state of the at least one valve.

A pressure reducer may be connected between the charging pump and the first fluid charging line to define a lower pressure one of said two different outputs of the charging system, the first charging line being connected to said lower pressure one of said two different outputs to connect the lower pressure supply of charging fluid to the first main fluid line in the first charging fluid supply/release state of the at least one valve.

The at least one charging-control valve may comprise first and second pilot-operated charging-control valves respectively installed in the first and second charging lines, with a pilot of the first pilot-operated charging-control valve connected to the second main fluid line and a pilot of the second pilot-operated charging-control valve connected to the first main fluid line.

In such instance, at least one, and optionally both, of the first and second pilot-operated charging-control valves may be a pilot-operated check valve.

Alternatively, at least one, and optionally both, of the first and second pilot-operated charging-control valves may be a pilot-operated sequence valve.

At least one of the pilot-operated charging-control valves may be configured to throttle fluid passing therethrough during low loading conditions of the differential hydraulic actuator, and to freely pass fluid therethrough in an unthrottled manner during higher loading conditions of the differential hydraulic actuator.

The at least one charging-control valve may comprise a charging-control valve whose movement in opposing directions is respectively driven by exposure of first and second piston areas to fluid pressure and respectively resisted by first and second springs. In such instance, said springs may have different spring constants, and said first and second piston areas may differ from one another.

The at least one charging-control valve may comprise a shuttle valve having a center position closing both the first and second charging lines, a first shifted position opening the first charging line to the charging system and closing the second charging line from the charging system to define the first charging fluid supply/release state, a second shifted position opening the second charging line to the charging system and closing the first charging line from the charging system to define the second charging fluid supply/release state, first and second piston areas arranged to shift the valve into the first and second shifted positions respectively when acted upon by sufficient fluid pressure, and first and second springs respectively resisting movement into the first and second shifted positions, wherein the piston areas differ from one another in size and/or the springs differ from one another in stiffness.

The at least one charging-control valve may comprise a shuttle valve having a center position throttling both the first and second charging lines and respectively connecting the first and second charging lines to differently pressured outlets of the charging system, a first shifted position opening the first charging line to the charging system and closing the second charging line from the charging system to define the first charging fluid supply/release state, and a second shifted position opening the second charging line to the charging system and closing the first charging line from the charging system to define the second charging fluid supply/release state.

Alternatively, the at least one charging-control valve may comprise a shuttle valve having a center position closing both the first and second charging lines from the differently pressured outlets of the charging system, a first shifted position opening the first charging line to the charging system and closing the second charging line from the charging system to define the first charging fluid supply/release state, and a second shifted position opening the second charging line to the charging system and closing the first charging line from the charging system to define the second charging fluid supply/release state.

The at least one charging-control valve may comprise a shuttle valve having a center position throttling or closing both the first and second charging lines, a first shifted position opening the first charging line to the charging system and closing the second charging line from the charging system to define the first charging fluid supply/release state, a second shifted position opening the second charging line to the charging system and closing the first charging line from the charging system to define the second charging fluid supply/release state, first and second piston areas arranged to shift the valve into the first and second shifted positions respectively when acted upon by sufficient fluid pressure, and first and second springs respectively resisting movement into the first and second shifted positions, wherein the piston areas differ from one another in size and/or the springs differ from one another in stiffness.

In the instance of a shuttle valve with said first and second piston areas and first and second springs, said piston areas may differ from one another in size, and said first and second springs may differ from one another in stiffness.

The set of one or more valves comprises one or more pilot-operated vibration-damping valves installed in one or both of the main lines and configured to throttle fluid passing therethrough during low loading conditions of the differential hydraulic actuator, and to freely pass fluid therethrough in an unthrottled manner during higher loading conditions of the differential hydraulic actuator.

In such instance, the one or more vibration-damping valves comprise one or more variable flow area valves each having a variable and controllable flow area, and arranged to maintain a smaller flow area during the low loading conditions before enlarging the flow area for the higher loading conditions.

In such instance, the one or more variable flow area valves are each arranged to gradually increase the flow area at a first rate during the lower loading conditions, and increase the flow area at a greater second rate during the higher loading conditions.

The valve having the variable and controllable flow area may be a spool and sleeve valve.

The one or more variable flow area valves may comprise first and second variable flow area valves respectively installed in the first and second main fluid lines.

The one or more vibration-damping valves comprise first and second pilot-operated counterbalance valves respectively installed in the first and second main fluid lines, with a pilot of the first pilot-operated counterbalance valve connected to the second main fluid line and a pilot of the second pilot-operated counterbalance valve connected to the first main fluid line.

According to a third aspect of the invention, there is provided a method of controlling operation of a differential hydraulic actuator via a hydraulic circuit comprising a reversible hydraulic pump cooperating with a differential hydraulic cylinder to provide a four quadrant mode operation including a first load-resistive actuator-extension quadrant, a second load-assistive actuator-extension quadrant, a third load-resistive actuator-retraction quadrant and a fourth load-assistive actuator-retraction quadrant; first and second main fluid lines respectively connecting first and second sides of the reversible hydraulic pump to extension and retraction sides of the differential hydraulic actuator; a hydraulic charging system for supplying/releasing charging fluid to and from the first and second main fluid lines to compensate for differential flow on opposing sides of the differential hydraulic actuator; first and second charging lines respectively connecting the charging circuit to the first and second main fluid lines; and at least one valve operably installed in the first and/or second charging lines and operable to switch between at least a first charging fluid supply/release state enabling flow through the first circuit-charging line between the first main fluid line and the charging circuit and a second charging fluid supply/release state enabling flow through the second circuit-charging line between the second main fluid line and the charging circuit; said method comprising running the hydraulic circuit in a throttled mode in a critical loading zone of the four-quadrant mode of operation, and running the hydraulic circuit in an unthrottled mode outside the critical loading zone, whereby the throttled mode provides vibration dampening in the critical loading zone, while throttling energy losses are avoided outside the shifted critical loading zone.

The method may comprise first shifting a critical loading range in a load-assisted extension quadrant of the reversible pump's operation to a lower loading range, and wherein running the hydraulic circuit in the throttled mode comprises running the hydraulic circuit in the throttled mode within the shifted critical loading range.

According to a fourth aspect of the invention, there is provided a method of controlling operation of a differential hydraulic actuator via a hydraulic circuit comprising a reversible hydraulic pump cooperating with a differential hydraulic cylinder to provide a four quadrant operation including a first load-resistive actuator-extension quadrant, a second load-assistive actuator-extension quadrant, a third load-resistive actuator-retraction quadrant and a fourth load-assistive actuator-retraction quadrant; first and second main fluid lines respectively connecting first and second sides of the reversible hydraulic pump to extension and retraction sides of the differential hydraulic actuator; a hydraulic charging system for supplying/releasing charging fluid to and from the first and second main fluid lines to compensate for differential flow on opposing sides of the differential hydraulic actuator; first and second charging lines respectively connecting the charging circuit to the first and second main fluid lines; and at least one valve operably installed in the first and/or second charging lines and operable to switch between at least a first charging fluid supply/release state enabling flow through the first circuit-charging line between the first main fluid line and the charging circuit and a second charging fluid supply/release state enabling flow through the second circuit-charging line between the second main fluid line and the charging circuit; said method comprising shifting a critical loading zone in the fourth load-assisted actuator-extension quadrant of the four quadrant operation to a lower loading range, whereby vibration amplitude in the critical loading zone is reduced due to lower loading values in the lower loading range of the shifted critical loading zone.

The method may comprise running the hydraulic circuit in a throttled mode in the shifted critical loading zone, and running the hydraulic circuit in an unthrottled mode outside the shifted critical loading zone, whereby the throttled mode provides vibration dampening in the shifted critical loading zone, while throttling energy losses are avoided outside the shifted critical loading zone.

Either method may comprise running two different charging pressures to the first and second charging lines.

In either method, the at least one valve operably installed in the first and second charging lines may comprise a dual-piloted valve having a first pilot input for displacing the valve in one direction and a second pilot input for the displacing the valve in an opposing direction, in which case the method may comprise using a difference in piston area and/or spring stiffness between the first and second inputs to shift the critical loading zone.

Either method may be performed with the hydraulic circuit from the first or second aspect of the invention.

According to a fifth aspect of the invention, there is provided a 4-way 3-position shuttle valve comprising:

first, second, third and fourth flow connection ports;

first and second pilot inputs operable to change the valve into different respective first and second operating conditions out of a normal default position;

wherein the valve is configured for restricted flow therethrough via the first and third ports and via the second and fourth ports in the normal default position to enable leakage flow from the first connection port to the third connection port and leakage flow from the second connection port to the fourth connection port, configured for unrestricted free-flow through the valve via the second and fourth connection ports in the first operating condition while preventing flow through the first and third connection ports, and configured for unrestricted free-flow through the valve via the first and third connection ports in the second operating condition while preventing flow through the second and fourth connection ports.

The valve may comprise:

a housing in which the first and second connection ports are defined at spaced apart locations in a longitudinal direction of the housing, and in which the third and fourth connection ports are defined at spaced apart locations in the longitudinal direction and situated between the first and second connection ports in the longitudinal direction;

a displaceable member slidably disposed within the housing for movement back and forth in the longitudinal direction along which opposing first and second ends of the displaceable member are spaced apart from one another, said displaceable member having a central flow-blocking portion disposed between the second and third connection ports in the longitudinal direction to block flow therebetween, and first and second flow-enabling portions respectively disposed between said central flow-blocking portion and first and second outer flow-obstructing portions;

first and second springs biasing the displaceable member into the default position, in which the central flow-blocking portion of the displaceable member resides between the third and fourth flow connection ports;

first and second pilot inputs operable under fluid pressure to displace the displaceable member in respective first and second directions out of the default position against the first and second springs, respectively, each pilot input comprising a chamber between a respective end of the housing and a respective end of the spool and having and a respective pilot path connecting a nearest one of the first and second connection ports to said chamber;

wherein the default position of the spool places the first and second outer flow obstructing portions of the spool in positions substantially, but not fully, obstructing the first and second connection ports and placing the first and second flow-enabling sections at the third and fourth connection ports to enable the leakage flow from the first connection port to the third connection port and from the second connection port to the fourth connection port, the first input is operable under sufficient fluid pressure to drive the displaceable member toward the first operating position in the first direction to increase the opening of the second connection port while maintaining an open state of the fourth connection port and reducing the leakage flow between the first and third connection ports before fully closing off said leakage flow between the first and third connection ports as the second connection port continues opening to enable free flow between the second and fourth connection ports in the first operating position, and the second input is operable under sufficient fluid pressure to drive the displaceable member toward the second operating position in the second direction to increase the opening of the first connection port while maintaining an open state of the third connection port and reducing the leakage flow between the second and fourth connection ports before fully closing off said leakage flow between the second and fourth connection ports as the first connection port continues opening to enable free flow between the first and third connection ports in the second operating position.

In one embodiment, the displaceable member is a spool, the flow-blocking portion is central land of said spool, the flow-enabling portions are valleys of said spool disposed between said central land and a pair of outer lands that define the outer flow-obstructing portions, and ends of the spool define respective piston areas of the first and second pilot inputs.

According to a sixth aspect of the invention, there is provided a 2-way select-throttling valve comprising:

first and second flow connection ports;

first and second pilot inputs operable to change the valve into different respective first and second operating conditions out of a normal default closed position;

wherein the valve is configured such that an open flow path through at least one of the first and second flow connection ports increases at a first rate as the valve initially exits the closed condition and transitions toward either of the operating condition, and then increases at a greater second rate as the valve approaches said either of the operating conditions.

The valve may comprise:

a housing having the first and second flow connection ports therein;

a displaceable member slidably disposed within the housing for movement back and forth along a longitudinal axis thereof, along which opposing first and second ends of the displaceable member are spaced apart from one another, said displaceable member having a flow-blocking portion residing between first and second flow-enabling portions thereof;

first and second springs biasing the displaceable member into the default closed position, in which the flow-blocking portion of the displaceable member blocks the first and second flow connection ports;

the first and second pilot inputs being operable under fluid pressure to displace the displaceable member in respective first and second directions out of the default closed position against the first and second spring, respectively, to shift the flow-blocking portion out of alignment between the flow connection ports and move a respective one of the first and second flow-enabling portions into place between with the first and second flow connection ports;

wherein at least one of the flow connection ports is of non-uniform cross-section with a wider inner portion at an interior of the housing and a narrower outer portion connecting said inner portion to an exterior of the housing such that the open flow-path of said at least one port increases at the first rate as the displaceable member initially moves out of the default closed position, and then increases at the greater second rate as the respective one of the flow-enabling portions reaches and traverses across the narrower outer portion.

In one embodiment, the displaceable member is a spool, the flow-blocking portion is central land of said spool that exceeds the wider inner portion of the flow connection ports in width, the flow-enabling portions are valleys of said spool disposed between said central land and a pair of outer lands, and ends of the spool define respective piston areas of the first and second pilot inputs.

BRIEF DESCRIPTION OF THE DRAWINGS

One embodiment of the invention will now be described in conjunction with the accompanying drawings in which:

FIG. 9 schematically illustrates a sixth embodiment hydraulic circuit in which both the pilot-operated check valves and counterbalancing valves of the fifth embodiment variant of FIG. 8A are replaced with pilot-operated selective-throttling valves installed in the charging lines to both shift the critical oscillatory zone in the load-assistive fourth quadrant retraction of the actuator, and throttle the differential flow during this critical zone.

In the drawings like characters of reference indicate corresponding parts in the different figures.

DETAILED DESCRIPTION

Figure 1:
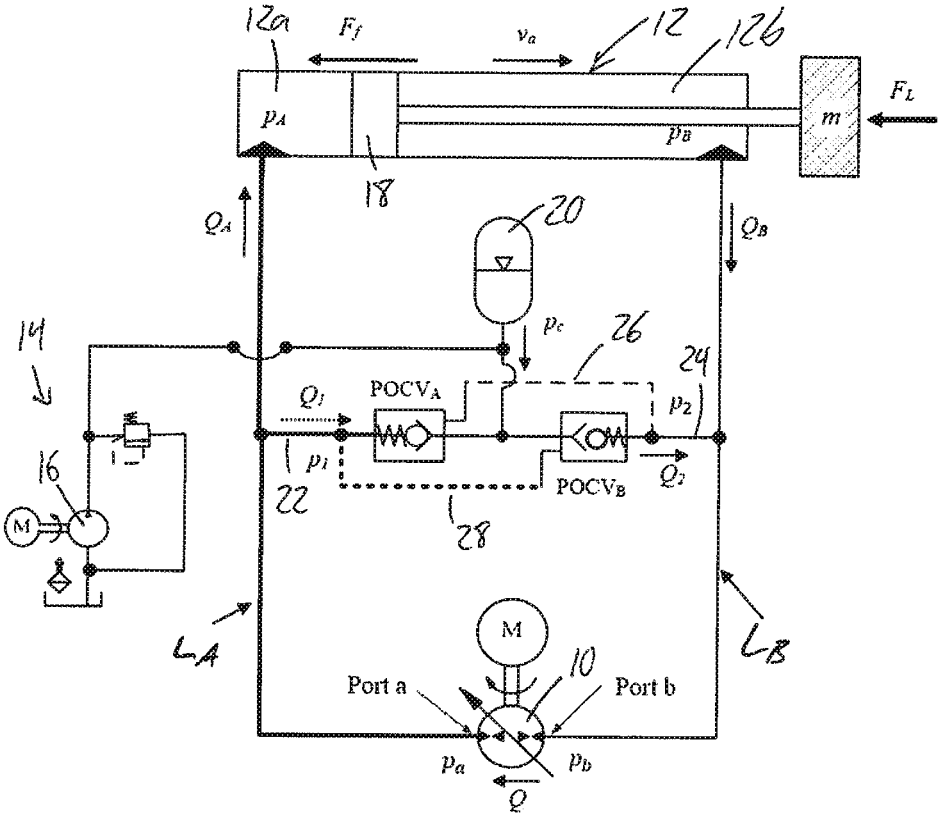
FIG.1 PRIOR ART
FIG. 1 schematically illustrates a prior art hydraulic circuit for pump-based control of a differential linear hydraulic actuator using piloted-operated check valves in a cross-pump line fed by a singular charging pressure.
Figure 2:
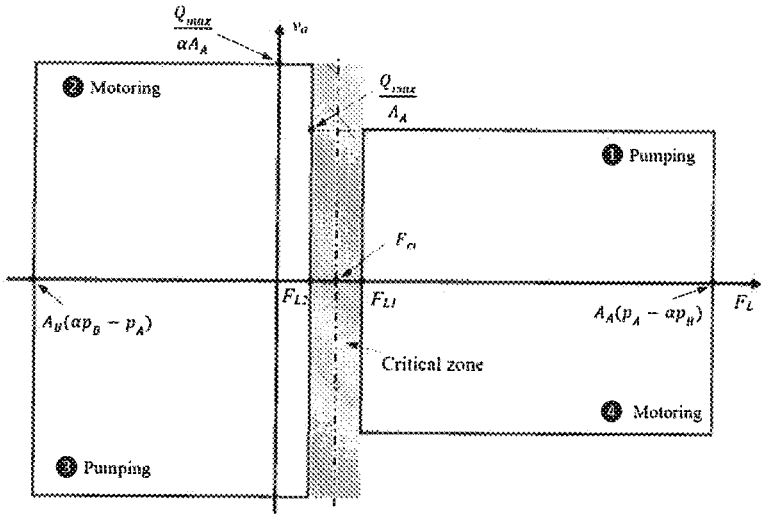
FIG.2 PRIOR ART
FIG. 2 shows a prior art outline of critical zones during pump mode of operation switching between the second and first quadrants and the fourth and third quadrants which, for simplicity, will be designated to be in the first and fourth quadrants of a four-quadrant operational area of a pump-controlled differential linear hydraulic actuator of FIG. 1.
Figure 4:
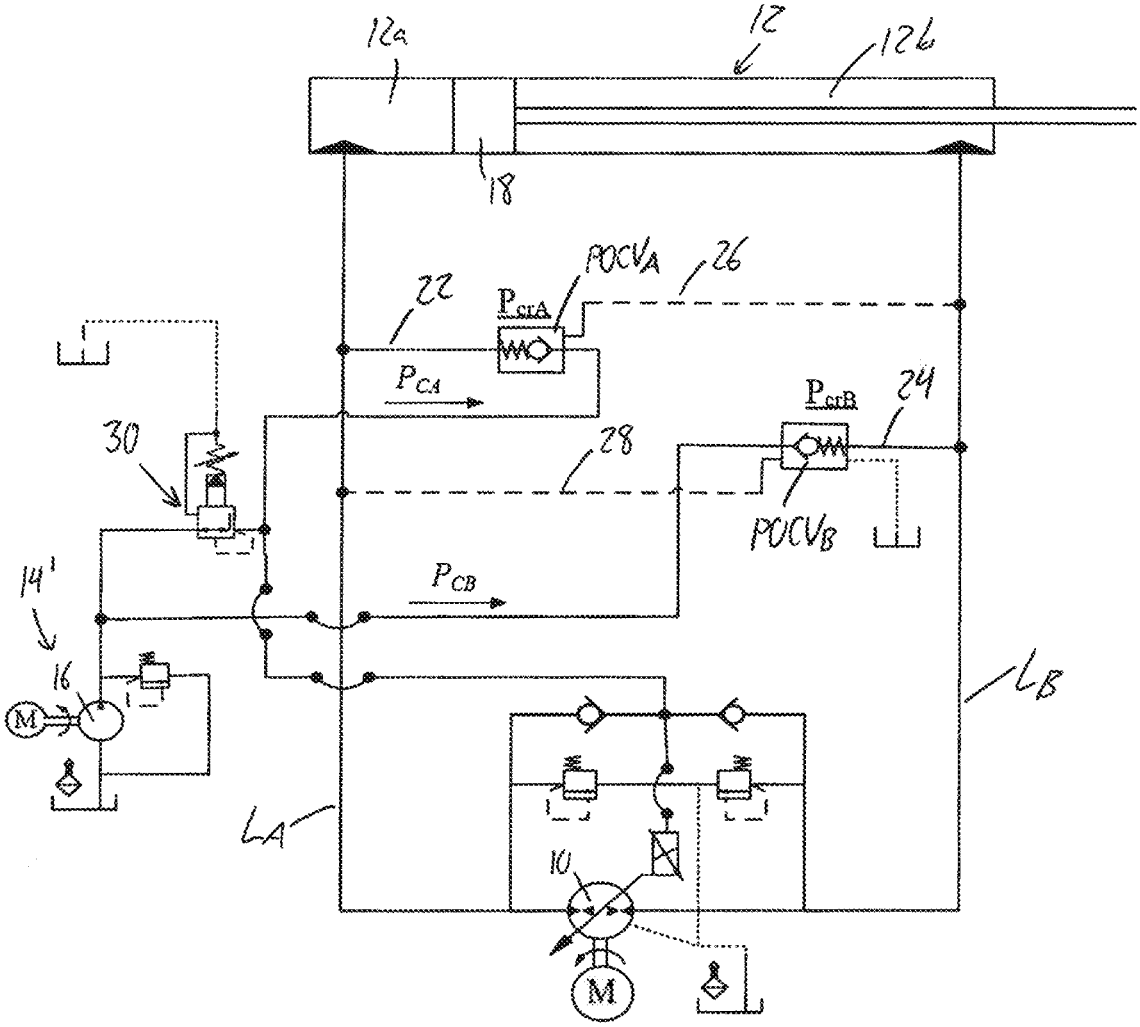
FIG. 4 schematically illustrates a first embodiment hydraulic circuit of the present invention for pump-based control of a differential linear hydraulic actuator using pair of piloted-operated check valves (potentially having different cracking pressures) in charging lines fed by two different charging pressures to shift the critical zones to lower loading ranges.
Figure 4A:
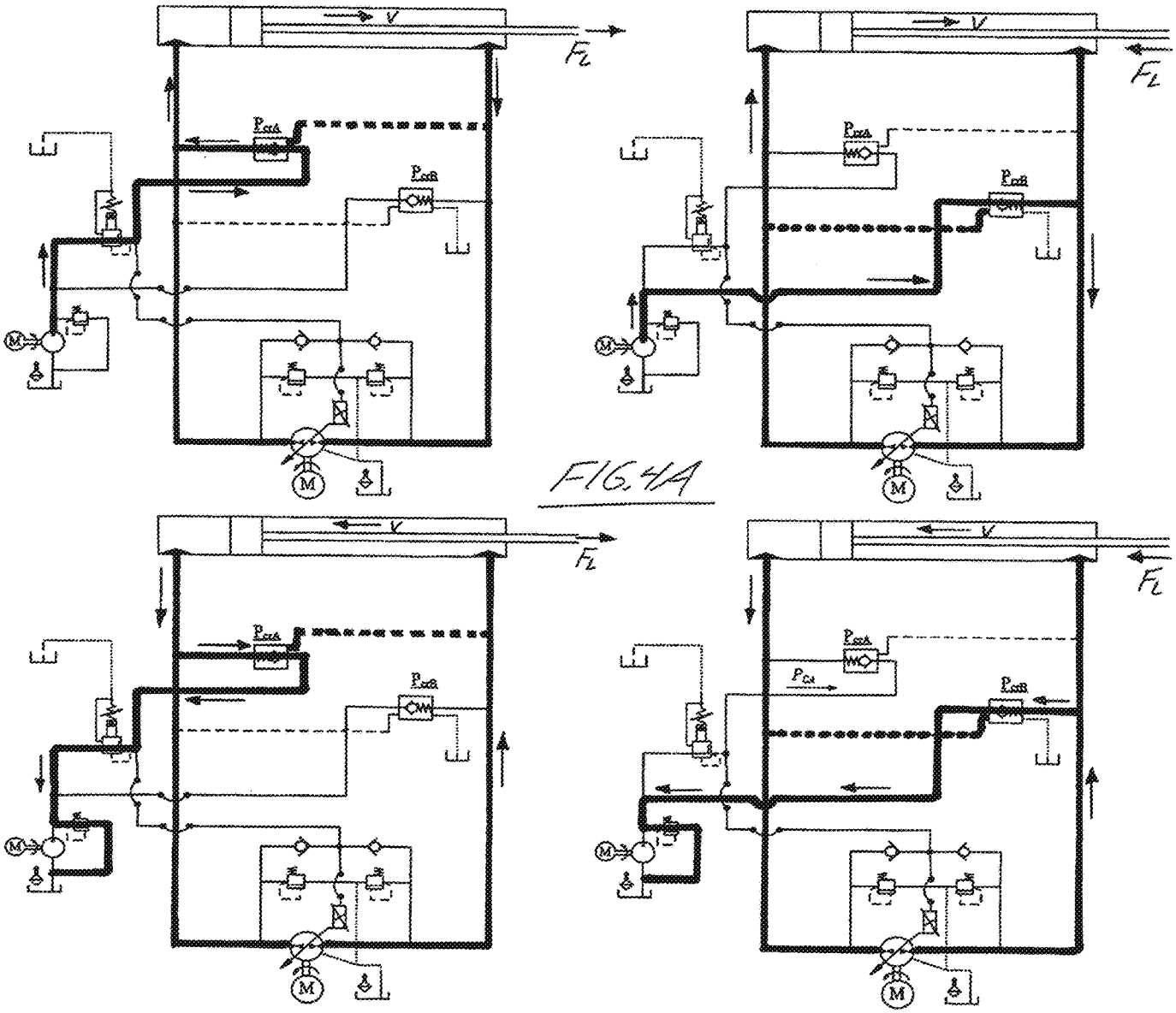
FIGS. 4A, 5A, 6B, 7A, 8B, 8C, 9A, 10A and 11A show the flow of hydraulic fluid through the circuits of FIGS. 4, 5, 6, 7, 8, 8A, 9, 10 and 11, respectively, in each of the four quadrants of operation, with the first to fourth quadrant operations shown sequentially counter-clockwise from the top right corner of the figure.

FIG. 4 illustrates a first embodiment hydraulic circuit of the present invention that, like the prior art circuit of FIG. 1, features the same layout of a reversible hydraulic pump 10, a single-rod differential linear actuator 12, and first and second main fluid lines $L_A$, $L_B$ respectively connecting the first and second sides of the reversible pump 10 to the extension and retraction sides 12*a*, 12*b* of the actuator, and likewise includes first and second pilot-operated check valves $POCV_A$, $POCV_B$ respectively installed on first and second charging lines 22, 24 that connect the first and second main fluid lines $L_A$, $L_B$ to a charging system 14' with a unidirectional pump 16. Once again, the POCVs are operated by way of cross pilot lines 26, 28 each connecting the pilot port of the respective POCV to the opposing main fluid line, whereby the differential flow to and from the cylinder in all four quadrants is accommodated in the same manner described for the prior art in the preceding background. The first and second pilot-operated check valves $POCV_A$, $POCV_B$ thus serve as the two charging-control valves of this embodiment.

Figure 3:
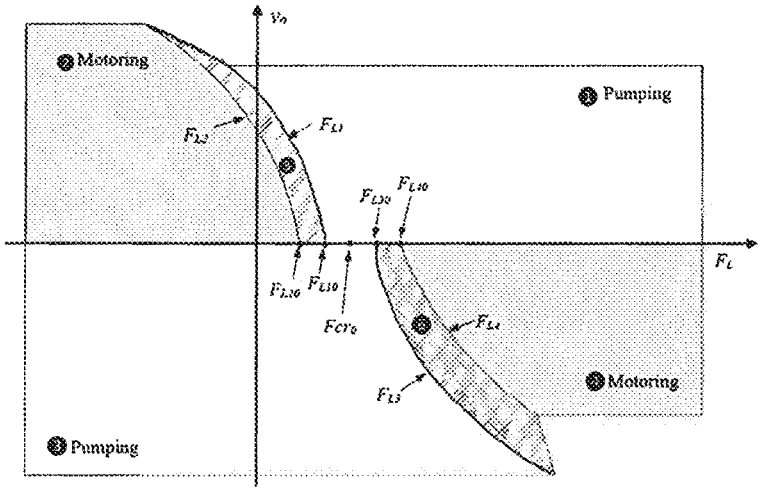
FIG. 3 shows more elaborate features of the critical zones for the FIG. 1 circuit taking into account the effect of transmission line losses, Coulomb and viscous frictions and cracking pressures of the POCVs.

However, the circuit differs from that of FIG. 1 in that the two charging lines 22, 24 are independent from one another and fed by two different outputs of the charging system 14'. The second charging line 24 and $POCV_B$ installed thereon are fed directly by the unidirectional charging pump 16, like in the circuit of FIG. 1, but the first charging line 22 and $POCV_A$ installed thereon are instead fed indirectly by the unidirectional charging pump 16 via a pressure reducing valve 30 that reduces the pressure of the charging fluid pumped by the charging pump 16. The feeding of $POCV_A$ by a lower charging pressure than $POCV_B$ causes the critical operation zones of FIG. 3 to shift toward the origin of the actuator-velocity/load-force plot along the x-axis, thus lowering the load force range spanned by each critical zone. Since the oscillation in the hydraulic circuit occurs at lower loading values due to this shifting of the critical oscillatory zone in the fourth quadrant, the effective degree of vibration experienced by the operator of the excavator or other machine is less pronounced, thus improving the overall operability of same.

Figure 5:
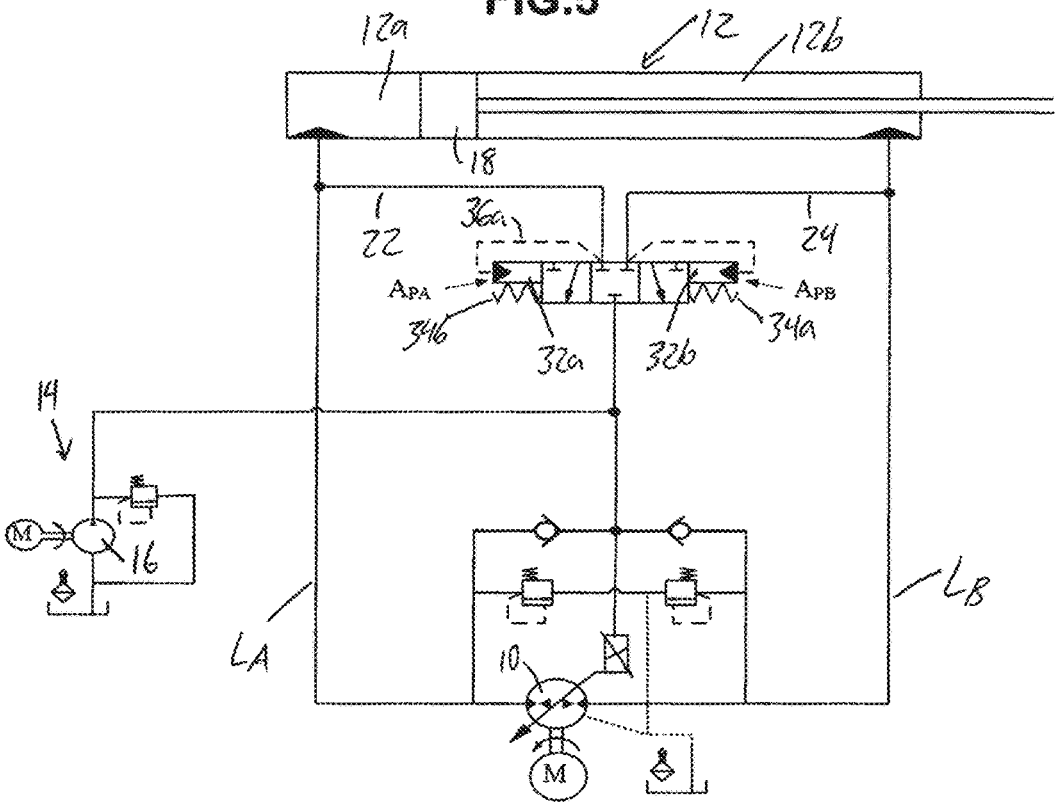
FIG. 5 schematically illustrates a second embodiment hydraulic circuit using a singular biased shuttle valve operated by a singular charging pressure to instead perform the critical zone shifting effected by the different charged POVCs of the first embodiment.

FIG. 5 shows a second embodiment which likewise performs shifting of the critical zones to lower ranges on the load force axis of the four quadrant operational plot, but instead of using two different respective charging pressures to uniquely characterize the two different actuating inputs respectively acting on the two POVCs, the circuit instead employs a singular 3-way 3-position double-piloted shuttle valve 32 as a singular charging-control valve of this embodiment that relies on a conventional single-pressure charging system 14 and is driven by two unique pilot inputs 32*a*, 32*b* from the two main lines $L_A$ and $L_B$. The purpose of the charge system's unilateral low pressure pump, low pressure relief valve and tank/reservoir is feeding or releasing flow from each of the main lines as the operation requirements. In quadrants 1 and 2 the charge pump 16 of the charging system feeds the line $L_B$ and $L_A$ to balance the flow to the main pump and actuator respectively. In quadrants 3 and 4, the relief valve in the charging system allows the release of the extra flow from lines $L_A$ and $L_B$, respectively. Rather than differing in terms of their charge pressure source, these uniquely characterized pilot inputs 32*a*, 32*b* instead differ from one another in terms of the piston surface area and/or spring constant used at each input. The shuttle valve is connected between the singular output of the single-pressure charging system 14 and each of the two charging lines 22, 24, and is biased into a center position by a pair of springs 34*a*, 34*b*. In this default center position, the valve 32 closes both of the charging lines 22, 24 from the singular outlet of the charging system, thus defining a normally-closed condition of the valve 32. The first pilot input 32*a* is fed from the first charging line 22 by a first pilot path 36*a*, where the fluid pressure from the first charging line 22 acts on the piston area $A_{PA}$ of the first pilot input 32*a* to drive movement of the shuttle valve in one direction. The second pilot input 32*b* is fed from the second charging line 24 by a second pilot path 36*b*, where the fluid pressure from the second charging line 24 acts on the piston area $A_{PB}$ of the second pilot input 32*b* to drive movement of the shuttle valve in the opposing direction. First spring 34*a*, has a first spring constant $k_{SA}$ that opposes actuation of the shuttle valve in the first direction by the pilot pressure at first input 32*a*, while second spring 34*b* has a different second spring constant $k_{SB}$ that opposes actuation of the shuttle valve in the second direction by the pilot pressure at second input 32*b*. The ratio between the two charge pressures and the ratio between the two spring stiffnesses are related to the ratio of the two piston areas.

In a first shifted position of the valve resulting from actuation of the valve 32 via first pilot input 32*a* against the resistance of first spring 34*a*, the valve connects the second charging line 24 to the charging system 14, while closing off the first charging line 22 therefrom. In the second shifted position of the valve resulting from actuation of the valve 32 via second pilot input 32*b* against the resistance of second spring 34*b*, the valve 32 connects the first charging line 22 to the charging system 14, while closing off the second charging line 24 therefrom. So like the POCVs in the first embodiment circuit of FIG. 4, the shuttle valve 32 connects the charging system to the first main fluid line $L_A$ via the first charging line 22 in the second and third quadrants of operation, and connects the charging system to the second main fluid line $L_B$ via the second charging line 24 in the first and fourth quadrants of operation, thereby accommodating the differential flow into and out of the actuator in all operational modes. However, by characterising the two actuation inputs of the shuttle valve 32 from one another by either piston area, resistive spring constant, or both, the singular charging pressure can accomplish the critical zone shifting function performed by the differently charged POCVs of the first embodiment. To accomplish this result, first input 32*a* is characterized by a larger piston area than second input 32*b* and/or by lesser spring stiffness at spring 34*a* than at spring 34*b*.

If the valve 32 instead had two identical pilot areas and springs of equal stiffness, undesirable switching back and forth between the two shifted positions of the valve (i.e. critical zone conditions) would occur around the area where the two pilot pressures from lines 22 and 24 are close to each other. At this condition, there would be a bias force exerted on the actuator due to the area difference between the two faces of the actuator piston 18. By using the differently characterized inputs, the shuttle valve of the inventive circuit accomplishes bias-balancing pressures because shifting the pressure balance at valve where switching occurs shifts the bias-force at the actuator (and consequently the load) to null value.

Shifting the critical zones causes the proper matching between the main pump null position (zero control volt→zero swash angle→-zero flow) and the actuator null position (zero actuation force→zero velocity), thereby avoiding the bias force created in the prior art by the single charge pressure and the identical valve(s) resulting in undesirable and uncontrollable motion, especially if there is no resistive load, which can create dangerous conditions in various applications, including applications other than excavation machine actuator control.

Figure 6:
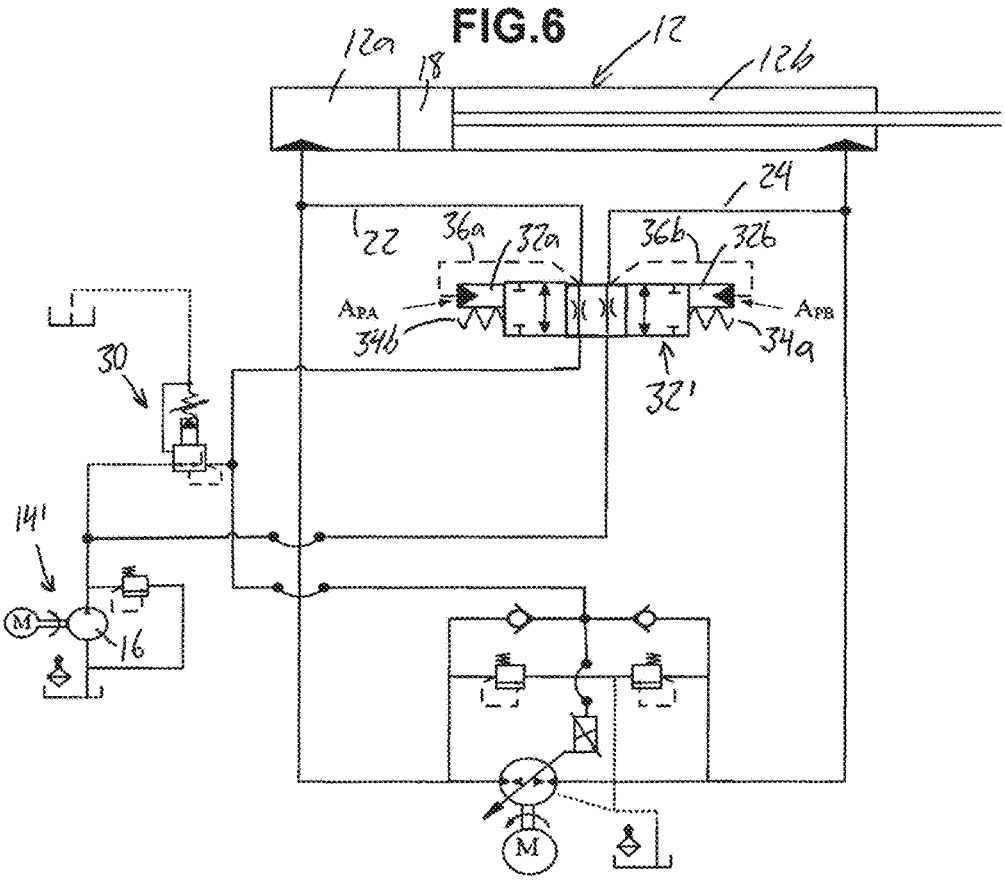
FIG. 6 schematically illustrates a third embodiment hydraulic circuit using a singular 4-way 3 position shuttle valve actuated in opposing directions by two different pilot pressures to both shift the critical zones and provide a leakage control action within the shifted critical zones.
Figure 5A:
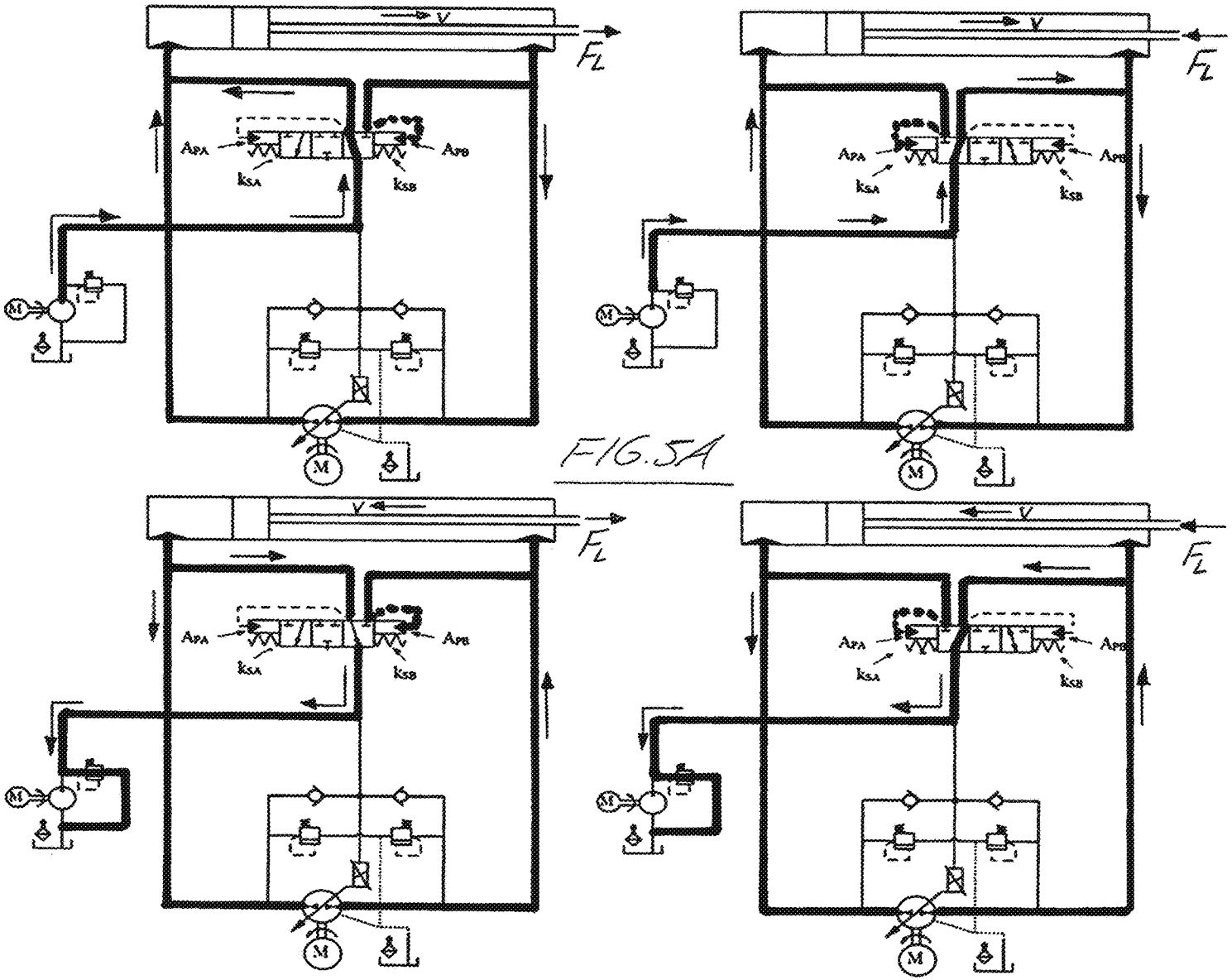

FIG. 6 shows a third embodiment hydraulic circuit again using a singular shuttle valve 32' having two pilot inputs 32*a*, 32*b* for driving the valve in opposing directions out of a default center position against the resistance of respective springs 34*a*, 34*b*, and using different piston areas and/or resistive spring constants for the two inputs. Like in FIG. 5, the first and second pilot inputs 32*a*, 32*b* are respectively fed by first and second pilot paths 36*a*, 36*b* coming off the first and second charging lines 22, 24. However, instead of using the conventional single-pressure charging system 14 of FIG. 5, the circuit instead uses the dual-pressure charging system 14' of FIG. 4, with a lower charging pressure provided from the pressure reducing valve 30 than directly from the charge pump 16. Accordingly, the shuttle valve 32' in this embodiment is a 4-way 3-position shuttle valve. In the default center position, the valve 32' provides a throttled connection of first charging line 22 to the lower pressure side of the dual-pressure charging system 14', and a throttled connection of second charging line 24 to the higher pressure side of the dual-pressure charging system 14'. In the first shifted position caused by sufficient pressurization of pilot input 32*a* against the resistance of spring 34*a*, second charging line 24 is connected to the higher pressure side of the dual-pressure charging system 14' for free-flowing unthrottled connection therebetween, while first charging line 22 is closed off from the charging system. In the second shifted position caused by sufficient pressurization of pilot input 32*b* against the resistance of spring 34*b*, first charging line 22 is connected to the lower pressure side of the dual-pressure charging system 14' for free-flowing unthrottled connection therebetween, while second charging line 24 is closed off from the charging system.

The initially centered position of shuttle valve 32' thus allows some intentional leakage of fluid between the main lines $L_A$, $L_B$ to the charging system 14' at lower loading conditions, until enough pilot pressure builds up to drive the shuttle valve into one of its two shifted free-flowing unthrottled conditions. Like in the first two embodiments, the use of different charging pressures and the use of different piston areas and/or spring constants cause the critical loading zones to shift to lower loading conditions of the operational map, during which dampening of the oscillations in the oscillatory critical zone is performed by the intentional leakage to the charging system through the throttled center position ports of the valve. The amplitude of the oscillations are thus dampened, thereby reducing the vibrational effect on the overall machine to improve the performance quality thereof. In the meantime, differential flow to and from the actuator is accommodated over the full operational area by opening up of second charging line 24 between the charging system and the second main fluid line in quadrants 1 and 4, and by opening up of first charging line 22 between the first main fluid line and the charging system in quadrants 2 and 3. In brief, the circuit acts to reduce the critical load value corresponding to the undesirable regions, thereby shifting the undesirable/critical performance region/zones in the oscillatory zone 6 towards the central origin of the load-force/actuator-velocity plot along the load-force axis to a lower range of loading values within which the undesirable performance may be induced, and applies leakage to dampen vibration at this shifted critical region. This reduces the leakage needed to stabilize the system and saves energy compared to the prior art. The shuttle valve 32' in this embodiment thus singularly serves as both a charging-control valve and vibration-damping valve of the hydraulic circuit. This embodiment is believed to possess improved performance compared to the first two embodiments, but has a more complex design.

Figure 20:
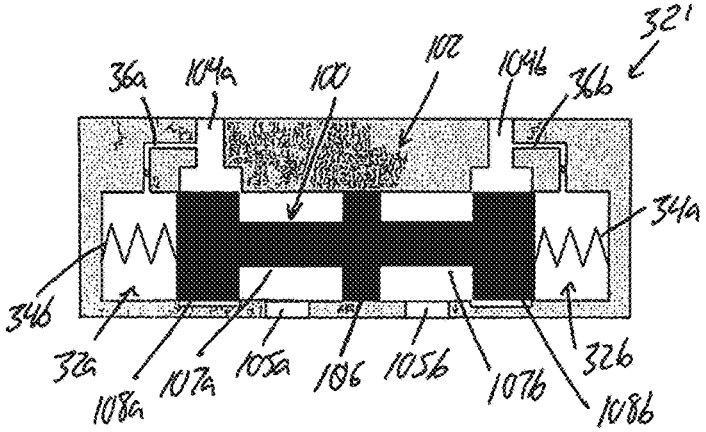
FIG. 20 schematically illustrates a 4-way 3-position shuttle valve employed in the third embodiment of FIG. 6.

FIG. 20 schematically illustrates the shuttle valve 32' of the FIG. 6 circuit. In the illustrated example, the valve is a spool valve in which an internal spool member 100 is linearly displaceable back and forth on a longitudinal axis of an outer housing 102 in which four flow connection ports 104*a*, 104*b*, 105*a*, 105*b* open radially into the housing. First and second connection ports 104*a*, 104*b* respectively connect to charging lines 22, 24, while third and fourth connection ports 105*a*, 105*b* respectively connect to the lower and higher pressure sides of the charging system. The third and fourth charging system ports are closer to one another and closer to the center of the valve than the first and second charging line ports. The displaceable spool member features a flow-blocking central land 106, two neighbouring flow-enabling valleys 107 on opposing sides thereof, and two flow-obstructing outer lands 108*a*, 108*b* at opposing ends of the spool. A respective chamber is defined between each end of the displaceable spool member and a respective closed end of the housing, and each chamber is fed by a respective channel in the housing wall that connects the chamber to a respective one of flow connection ports 104*a*, 104*b*. Each chamber and the respective outer landed end of the spool thus collectively define a respective one of the pilot inputs 32*a*, 32*b*, at which the respective end of the spool defines the piston area of this pilot input, while the respective channel of each chamber defines the respective pilot path 36*a*, 36*b* for fluid-based operation of the pilot input.

Springs 34*a*, 34*b* each reside between one end of the displaceable spool member and a respective end of the housing to bias the spool into the centered position, where the central land 106 of the spool resides between the first and second charging line connection ports 104*a*, 104*b* and between the third and fourth charging system connection ports 105*a*, 105*b*. In the centered spool position, the first and second flow-obstructing outer lands 108*a*, 108*b* respectively block off the substantial majority of the charging line connection ports 104*a*, 104*b*, but leave a small fraction of each charging line connection port open at the side thereof nearest the other charging line connection port. In the centered spool position, the third charging system connection port 105*a* is left open at the first flow-enabling spool valley 107*a*, and the fourth charging system connection port 105*b* is likewise left open at the second flow-enabling spool valley 107*b*. This way, in the normal centered position of the valve spool, some intentional fluid leakage can occur between the first charging line connection port 104*a* and the third charging system connection port 105*a*, and also between the second charging line connection port 104*b* and the fourth charging system connection port 105*b*.

Under application of sufficient pressure against the first landed end of the spool at the first pilot input 32*a*, the spool shifts in first direction along the longitudinal axis of the housing, moving the first outer land 108*a* into a position fully sealed with an intact area of the housing's internal periphery at a location situated axially between the first charging line connection port 104*a* and the third charging system connection port 105*a*, thereby fully closing off these two ports from one another. At the same time, the second outer land 108*b* is pushed toward the nearest end of the housing in order to further open the second charging line connection port 104*b*. This travel is short enough that the central land 106 remains between the third and fourth charging system ports 105*a*, 105*b* and thus does not close off the fourth charging system connection port 105*b* from the fully opened second charging line connection port 104*b*. Accordingly, the second charging line connection port 104*b* and the fourth charging system connection port 105*b* are open to one another in this first shifted position to enable flow between the second charging line and the higher pressure side of the dual-pressure charging system, while the first charging line and the lower pressure side of the dual-pressure charging system are closed off from one another by the first outer land 108*a* of the spool. With sufficient pilot pressure at the second input 32*b*, shifting in the reverse direction likewise uses the second outer land 108*b* to close the second charging line connection port 104*b* and the fourth charging system connection port 105*b* from one another while further opening the first charging line connection 104*a* to enable flow between the first charging line and the lower pressure side of the dual-pressure charging system.

Figure 6A:
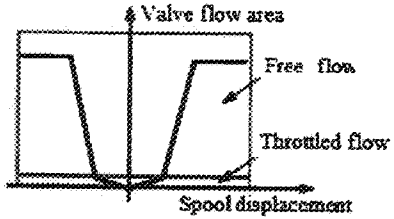
FIG. 6A schematically illustrates a variant of the FIG. 8 circuit in which the 4-way 3-position shuttle valve has a closed center position rather than an open center position allowing some intentional leakage flow through the valve.
Figure 6A:
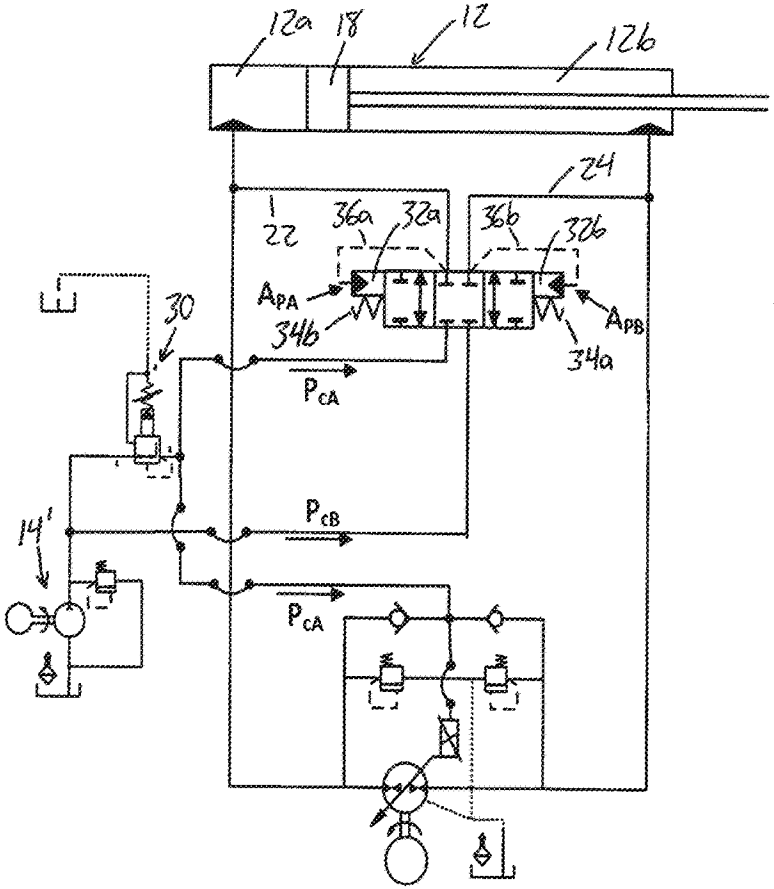
Figure 6B:
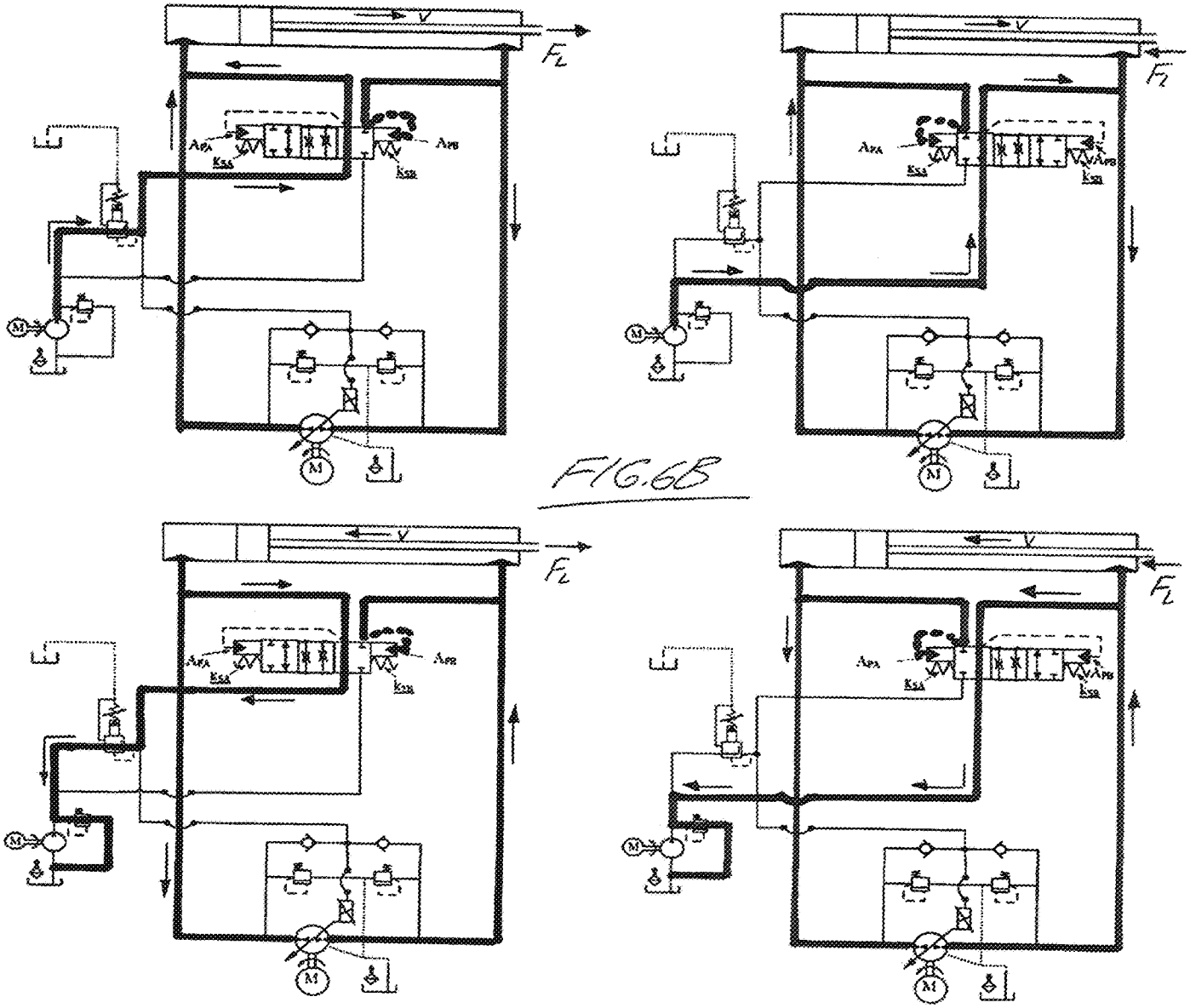
Figure 7A:
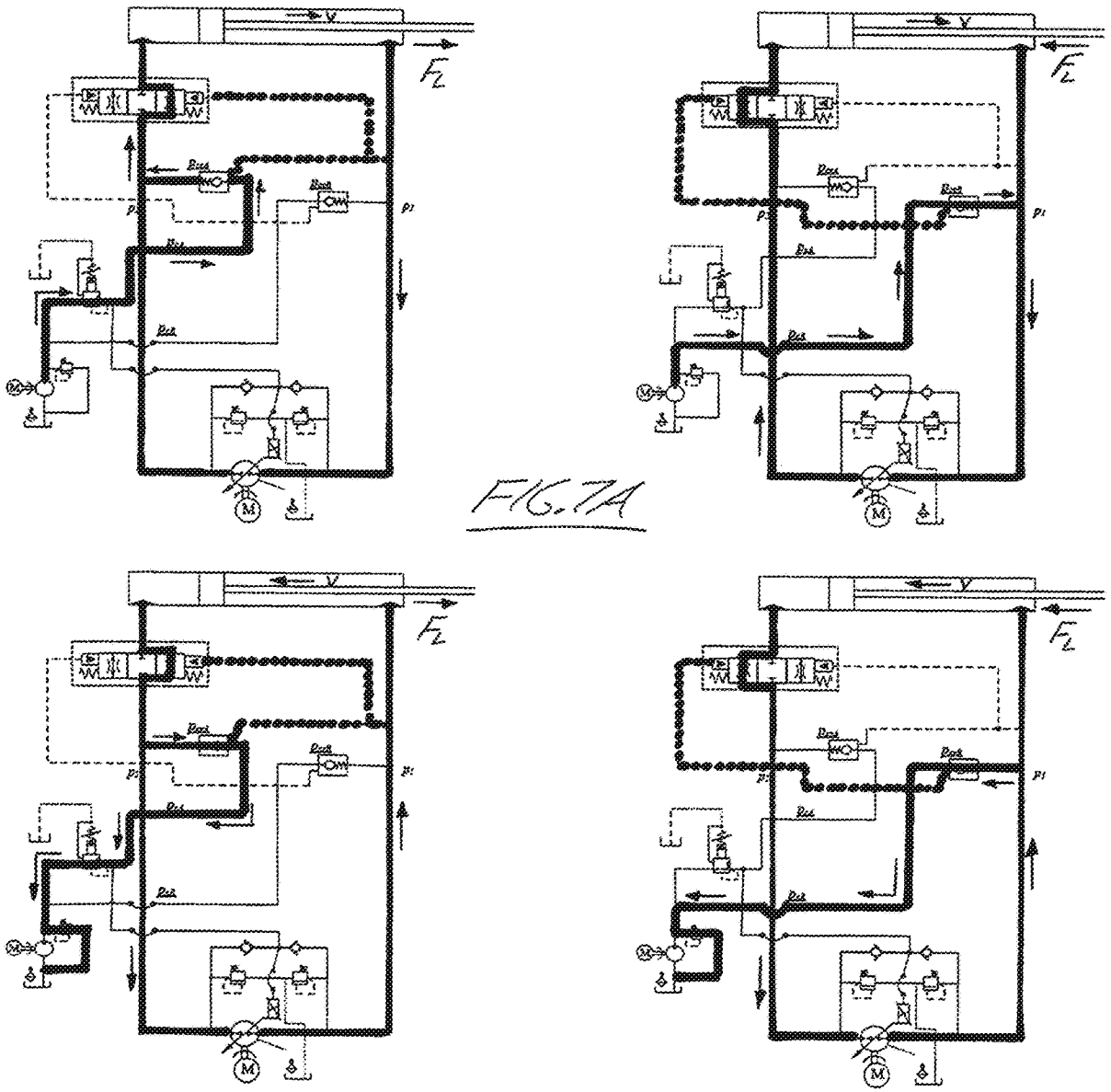

FIG. 6A shows a variant of the FIG. 6 circuit in which the 4-way 3-position shuttle valve is not open in its default center position to allow throttled leakage therethrough, and instead is fully closed in the center position.

Figure 7:
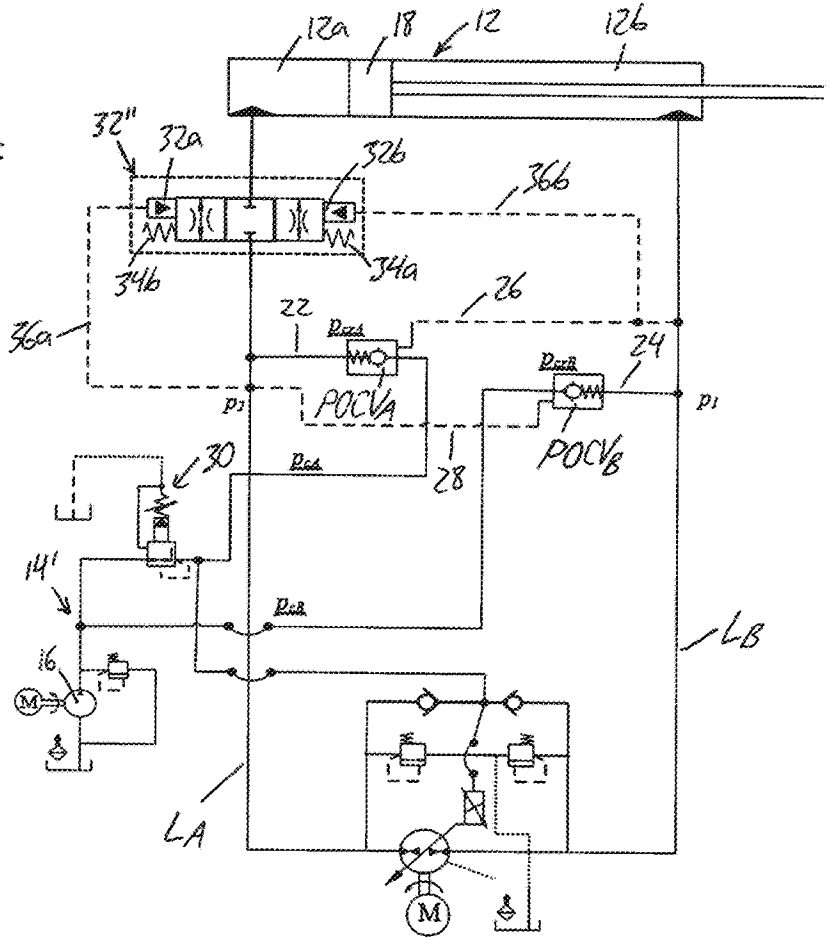
FIG. 7 schematically illustrates a fourth embodiment hydraulic circuit using the two differently charged pilot-operated check valves of the first embodiment for zone-shifting functionality together with a single dual-piloted selective-throttling valve on one of the main fluid lines to throttle flow therethrough only at the low loading values of the shifted critical zones.

FIG. 7 illustrates a fourth embodiment hydraulic circuit of the present invention, which like the first embodiment circuit of FIG. 4 features first and second pilot-operated check valves $POCV_A$, $POCV_B$ respectively installed on first and second charging lines 22, 24 that connect the first and second main fluid lines $L_A$, $L_B$ to lower and higher pressure sides of the dual-pressure charging system 14', and are operated by way of cross pilot lines 26, 28 each connecting the pilot port of the POCV to the opposing main fluid line. The fourth embodiment thus features the same critical zone-shifting functionality as the first embodiment to reduce oscillatory behaviour in the actuator of the machine by reducing the load range over which critical loading oscillation occurs in the fourth quadrant of operation.

The fourth embodiment circuit differs from the first embodiment in the addition of a selective-throttling valve 32", and differs from the second and third embodiments in both the type of valve employed for this dampening function and its position within the circuit. Particularly, the illustrated valve 32" is a 2-way valve installed in the first main fluid line $L_A$ near the connection thereof to the extension side 12*a* of the actuator 12. Like the correspondingly numbered valves 32, 32' of the preceding embodiments, the purpose of this vibration dampening valve 32" is to reduce oscillations under critical loading conditions. This valve 32" may alternatively be installed in the second main fluid line $L_B$, but locating the valve 32" in the first main line $L_A$ is preferred, since experimental results have showed that oscillatory motions are more noticeable during actuator retraction of assistive load (quadrant 4), where the load is acting to pressurize the fluid in the capped extension side of the actuator. The pilot-operated actuation inputs at 32*a*, 32*b* at opposing ends of the valve 32" are activated via pilot paths 36*a*, 36*b* from the two pilot lines 26, 28 of the POCVs, whereby fluid pressure from first main fluid line $L_A$ drives the valve in one direction out of a normally centered position, while fluid pressure from second main fluid line $L_B$ drives the valve in an opposing direction out of the normally centered position. Once again, motion of the valve 32" in each direction out of center is resisted by a respective spring 34*a*, 34*b*, whereby the springs cooperate to normally center the valve. Spring 34*a* resists pressure-based operated of piloted input 32*a*, while spring 34*b* resists pressure-based actuation of piloted input 32*b*.

The valve has a variable flow area controlled as a function of the piloting pressure differential, for example using a spool-sleeve throttling configuration and balance springs to achieve the flow-area profile shown in the inset of FIG. 7, where it can be seen that at its centered position (zero-displacement), the open flow area of the valve is zero. In each direction from the centered position, the flow-area gradually increases at a first rate denoted by the gradual slope shown rising slowly away from the origin of the graphical represented flow-area profile in the FIG. 7 inset, until the flow-area's rate of increase rises dramatically at a predetermined point of displacement, as shown by the transition to a notably steeper slope in the graphically represented profile. Within the displacement range between the predetermined displacement points in the positive and negative directions from center, the low flow-through area of the valve performs a throttling action on the fluid passing therethrough. Beyond these points the flow-through area of the valve increases quickly to a free-flow state allowing the fluid to pass freely therethrough with no throttling action thereon. The pre-set displacement points at which the valve transitions from its throttling condition to its free-flowing state are set for a given circuit according to the pilot pressures at which the load value $F_L$ has moved beyond the critical range, whereby throttling of the fluid in the hydraulic circuit is only performed in the critical zones to dampen the vibration/oscillation experienced therein, while the free-flowing state of the valve avoids unnecessary throttling in all other regions, which represent the majority of the overall operating area of the circuit. The energy inefficiencies of throttling are therefore only exploited where needed, while efficient unthrottled operation of the circuit is retained elsewhere.

In other words, the main idea behind the FIG. 7 circuit is to utilize flow throttling to control the actuator motion, exclusively, in the regions where responses are not satisfactory. In other regions, motion is controlled in a throttle-less manner. Throttling of hydraulic fluid creates pressure drop across the valve orifices maintaining increased pressure in cylinder chambers compared to pump ports which contribute towards a stiffer actuator [24, 28]. The circuit of FIG. 7 possesses a comparable energy efficiency and energy regeneration ability to the prior art circuit with POCVs (FIG. 1) at high loading conditions, and the stability of the prior art circuits with throttling valves (not shown) at low loading conditions. Furthermore, the present design does not require additional electronic control, which is desirable in industrial settings. Instead, the valve 32" is pilot-operated through the same pilot lines that actuate the POCVs in order to dampen the undesirable responses in the regions of interest. The valve also throttles the flow in the transmission line when the two pilot pressures are close to each other, but allow free flow in and out of the actuator when the two pilot pressures are not close to each other and throttling is unnecessary. This embodiment thus uses the two POCVs as its charging-control valves, and its shuttle valve 32" as a singular pilot-operated vibration damping valve.

Figure 21:
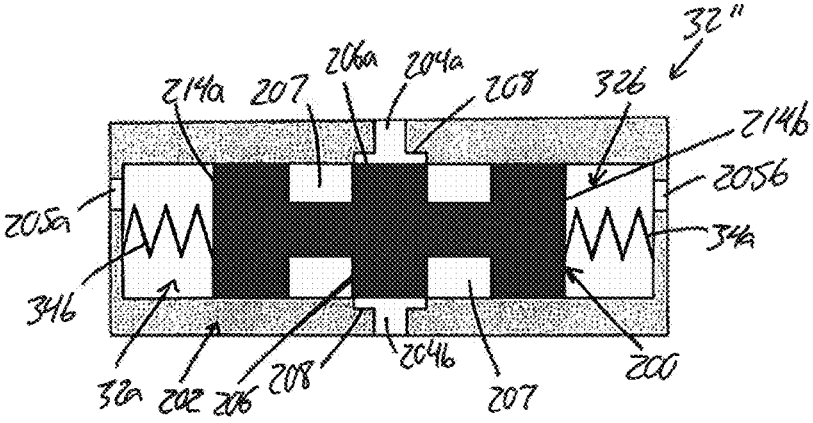
FIG. 21 schematically illustrates a dual-piloted selective-throttling valve employed in the fourth embodiment of FIG. 7.

FIG. 21 schematically illustrates the dual-piloted selective-throttling valve 32" employed in the fourth embodiment of FIG. 7. In the illustrated example, the valve is a spool valve in which an internal spool member 200 is linearly displaceable back and forth on a longitudinal axis of an outer sleeve-shaped housing 202 in which two flow connection ports 204*a*, 204*b* open radially into the housing in alignment with one another at diametrically opposing points of the housing near an axial center thereof. Pilot ports 205*a*, 205*b* open into the housing at longitudinally opposing ends thereof and feed into respective chambers defined between the ends of the displaceable spool member and the respective ends of the housing. Each chamber, the respective pilot port, and the respective end of the spool thus define a respective one of the pilot inputs 32*a*, 32*b*, at which the respective end of the spool defines the piston area of this pilot input. Springs 34*a*, 34*b* each reside between one end of the displaceable spool member and a respective end of the housing to bias the spool into the centered position, where a central land 206 of the displaceable spool member forms a flow-blocking portion of the spool closing off the two flow connection ports 204*a*, 204*b* to define the normally closed state of the valve. The flow-blocking central land 206 is neighboured by two flow-enabling valleys 207 on opposing sides thereof to define two flow-enabling portions of the spool.

With continued reference to FIG. 21, each flow connection port has a non-uniform cross section having a narrow portion of smaller cross-sectional area intersecting the exterior of the housing and a wider portion of larger cross-sectional area intersecting the interior of the housing. The wider portion of this stepped-width port structure spans a shorter axial length of the connection port (i.e. radial thickness of the housing walls) than the smaller diameter portion of the connection port. The central land 206 of the displaceable spool member 200 is wide enough to fully span the wider portion of each connection port at the interior of the housing wall, thus fully closing off the two flow connection ports from one another.

When the pilot pressure in one of the pilot inputs 32*a*, 32*b* of the FIG. 21 valve is high enough to overcome the bias of the respective spring 34*a*, 34*b* at the opposing end of the valve, the shifting of the spool 200 toward the opposing end of the housing 202 starts to open up the two flow connection ports 204*a*, 204*b* by moving the flow-blocking central land 206 out of alignment between the flow connection ports and shifting the neigbouring flow-enabling valley 207 into place between the flow connection ports. During this initial movement, flow through each connection port 204*a*, 204*b* is restricted to a path moving around the central land of the spool via a small axial flow path travelling axially of the housing and delimited between the outer periphery 206*a* of the central land and the shoulder or step 208 created at the transition between the two differently-sized portions of the port, and a small radial flow path opening into the respective flow-enabling valley 207 that is moving into place between the widened inner ends of the connection ports 204*a*, 204*b*. As the pilot pressure increases and more of the flow-enabling valley 207 moves into the space between the connection ports 204*a*, 204*b*, the radial flow path increases in size while the axial flow path remains constant, until the flow enabling-valley 207 reaches the space between the narrowed outer ends of the connection ports 204*a*, 204*b*.

At this point, the fluid is no longer limited to a flow path around the central land 206 via the constricted axial-flow path, as direct radial flow straight through the narrower outer portion of each port is now also allowed. As the flow-enabling valley 207 of the spool moves into full alignment between the connection ports, the overall available flow area thus now increases at a greater rate, as more and more area of the narrower outer portions of the flow connections points are opened by movement of the flow-blocking land fully out from between the connection ports. In the fully shifted position of the spool, the respective flow-enabling valley 207 spans the full width of the widened inner ends of the connection ports, thus maximizing the available flow area to enable unthrottled free flow through the valve. Outer flow-blocking lands 214*a*, 214*b* at the opposing ends of the spool seal off the flow-enabling valleys 207 and the connection ports 204*a*, 204*b* from the pilot inputs 32*a*, 32*b* at the ends of the housing. Accordingly, the flow through the valve is only throttled during initial displacement of the spool at low loading conditions of the hydraulic circuit, until central flow-obstructing land if the displaceable spool 206 clears the respective shoulder 208 of each stepped-width connection ports.

Figure 8A:
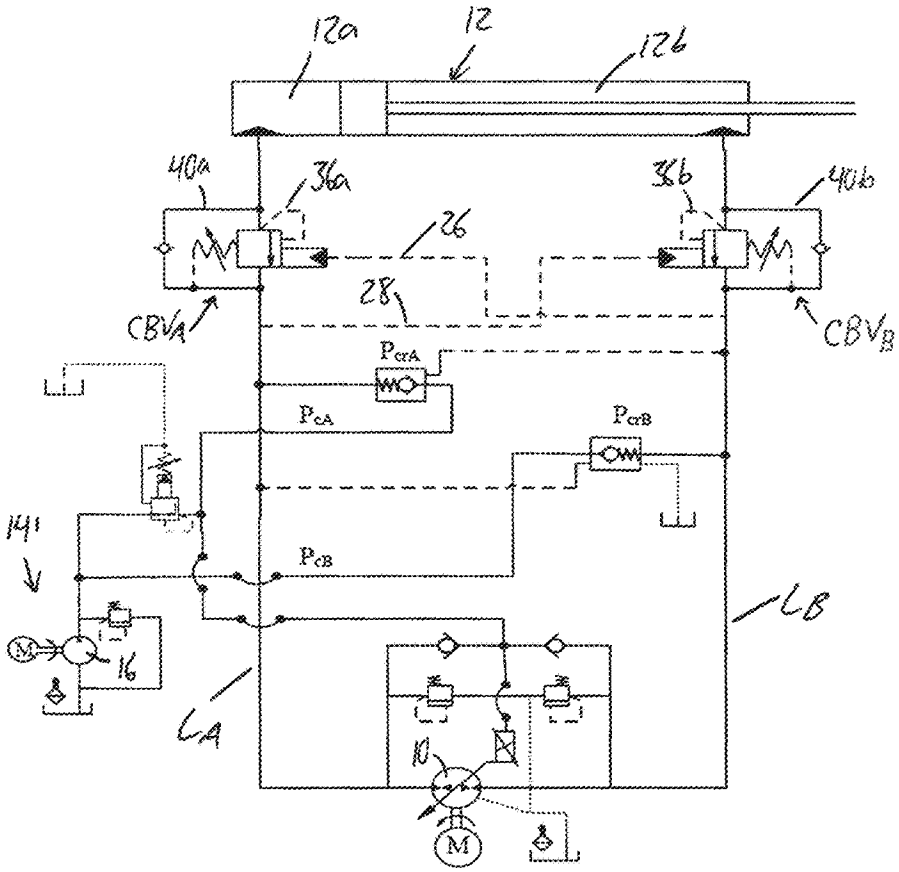
FIG. 8A schematically illustrates a variant of the FIG. 8 circuit modified to include the differently charged pilot-operated check valves of the first and fourth embodiments for shifting of the critical loading zones.
Figure 8:
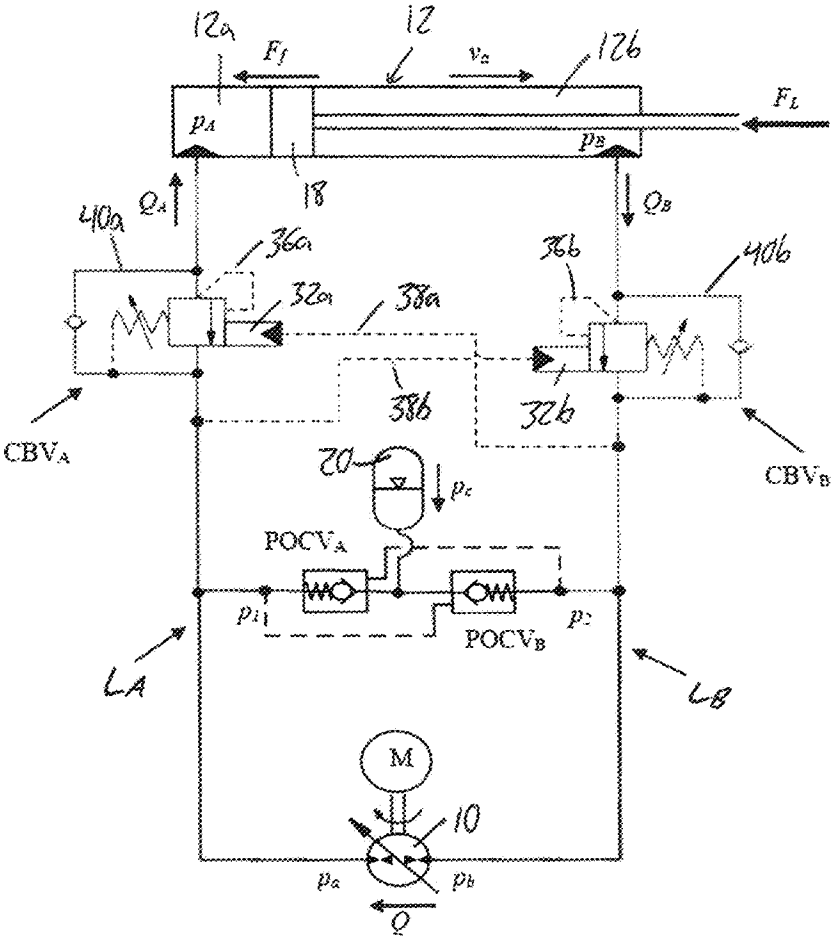
FIG. 8 schematically illustrates fifth embodiment hydraulic circuit in which the single dual-piloted selective-throttling valve from the fourth embodiment is replaced by two counterbalancing valves respectively installed in the two main fluid lines to perform the selective throttling at the low loading values, and a single-charging pressure is used for simplification.
Figure 8B:
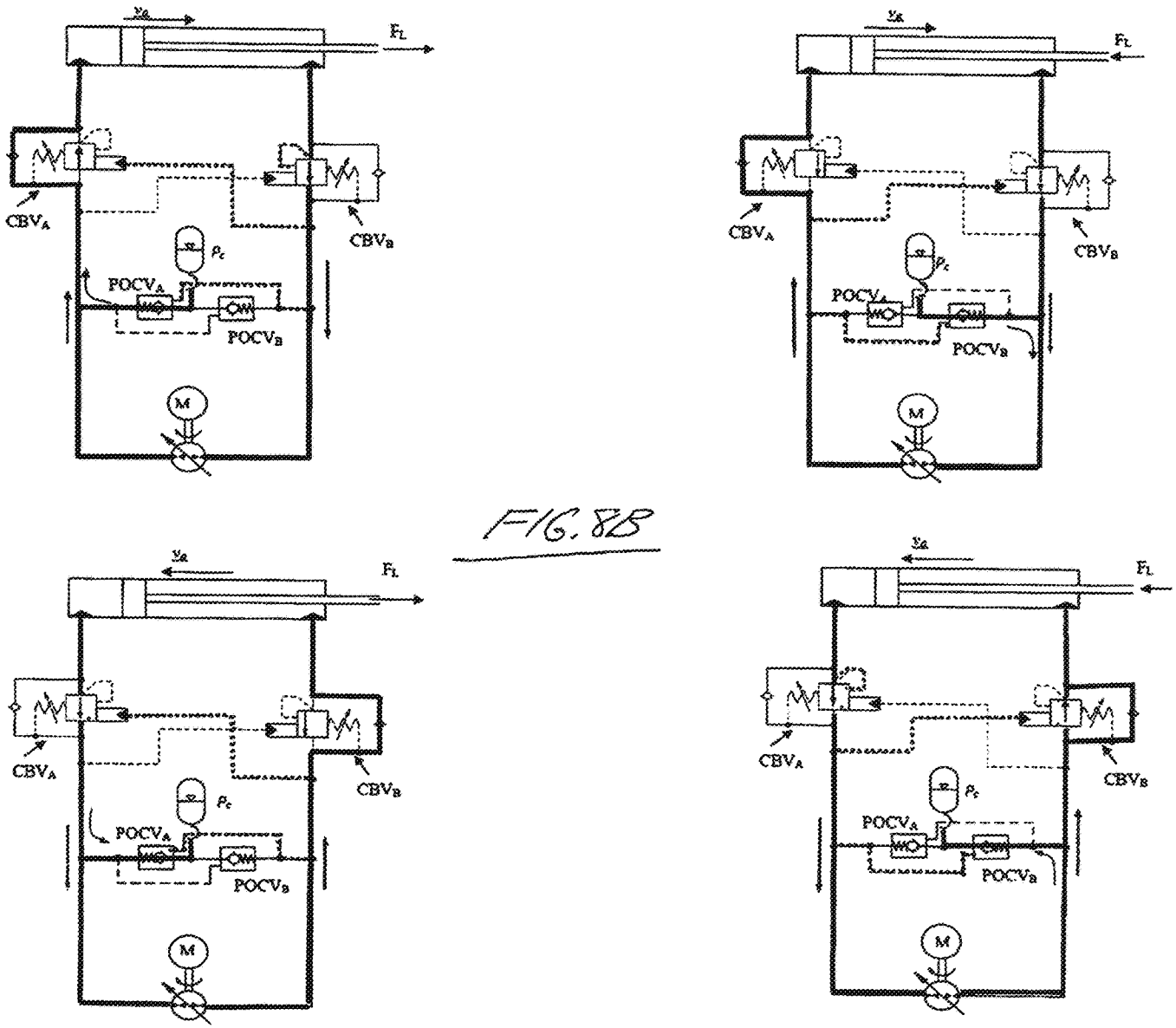
Figure 8C:
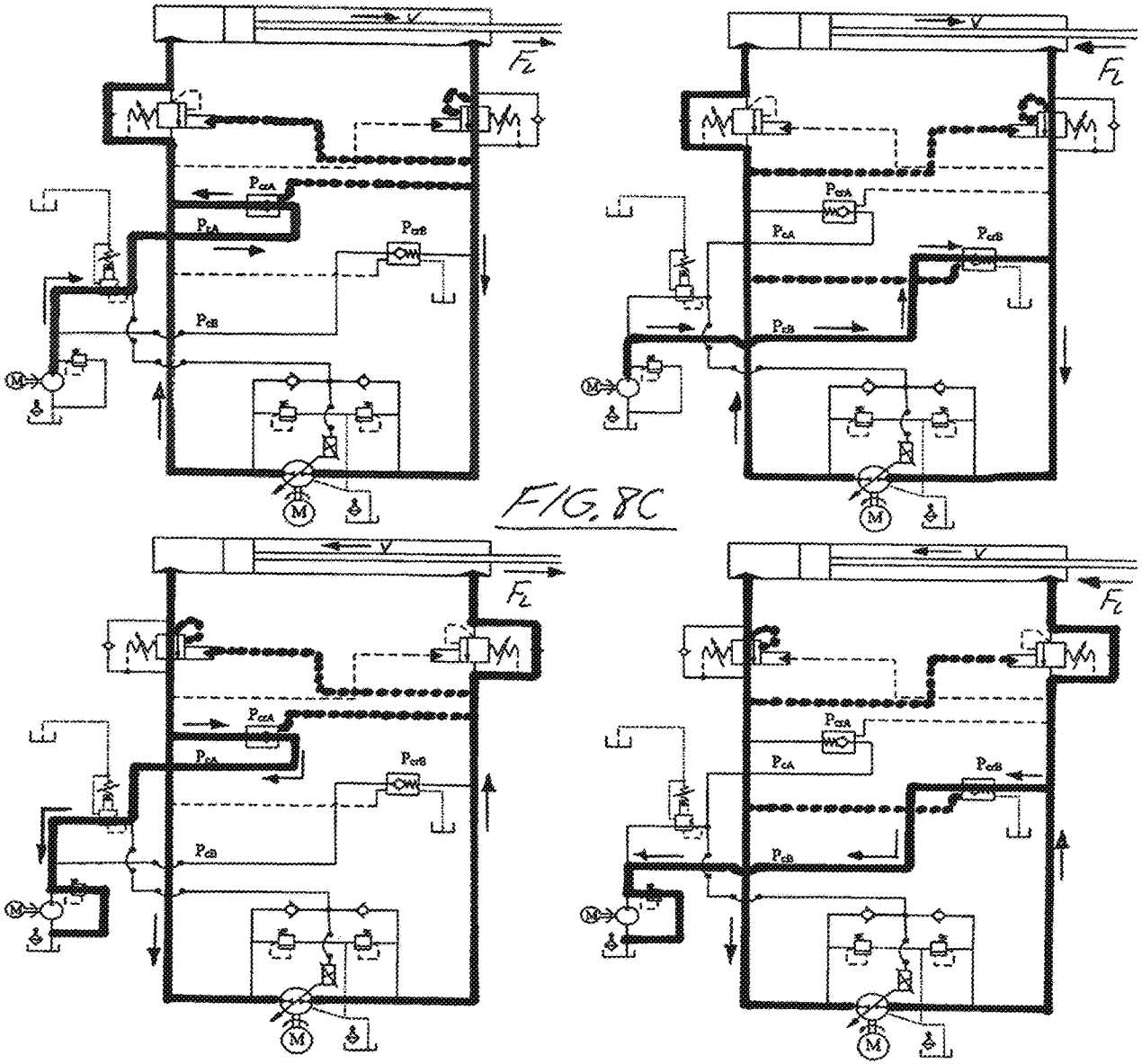

FIG. 8 shows a fifth embodiment circuit which employs the same selective-throttling operation principle as the fourth embodiment, but uses readily available off-the-shelf parts in place of the unique valve 32" to provide similar selective-throttling effect. In the FIG. 8 implementation, first and second counterbalance valves $CBV_A$, $CBV_B$ are instead installed in the first and second main fluid lines $L_A$, $L_B$, respectively, near the connections to the extension and retraction sides of the actuator 12 to serve as the embodiment's two pilot-operated vibration-damping valves, while two POCVs serve as the embodiment's two charging-control valves. Generally, CBVs are throttling valves typically used for safety requirements through the whole working range actuator operation. They have been used in some pump-controlled applications [6, 24, 15, 29], but with no ability to regenerate energy [24]. Here, the CBVs are utilized to only restrict flow at low loading conditions to enhance the performance while allowing free flow at high loading conditions to allow energy regeneration. $CBV_A$, is operable by pressure at a respective pilot input port 32*a* fed by a cross pilot line 38*a* connected to the second main fluid line $L_B$, while $CBV_B$ is operable by pressure at a respective pilot input port 32*b* fed by a cross pilot line 38*b* connected to the first main fluid line $L_A$. In addition to the cross pilot line from the opposing main fluid line, the pilot input of each CBV is also fed by a respective pilot path from the same main fluid line on which the valve is installed, from a point situated on the actuator-side of the valve. This is shown in the figure by pilot path 36*a* of $CBV_A$ and pilot path 36*b* of $CBV_B$.

Each CBV is normally closed, and is only opened on the presence of the sufficient pilot pressure from either or both of its pilot sources 36*a*, 32*a*/36*b*, 32*b*. In its initial stages of opening, each CBV is only partially opened, and has a reduced flow area relative to the respective main fluid line, thus throttling the fluid passing through it. However, as the respective pilot pressure increases due to the rising pressure at the other main fluid line, the CBV opens further, exposing an unrestricted flow area allowing free, unthrottled flow therethrough. So like the pilot-controlled spool and sleeve valve 32 of FIG. 7, the CBV only throttles at low loading values, thus limiting throttling primarily, if not entirely, to the critical zones shifted down to such lower loading ranges in the operational performance map. In brief, this embodiment employs a singular charge pressure source and two POCVs and two counterbalance valves (CBVs) for limited throttling. Compared to the prior art, this design reduces the throttling margin and saves energy, while providing more flexibility, including use of separate settings for each CBV to deal with the two different regions of undesirable performance.

FIG. 8 shows the circuit during load-resisting extension of the actuator in a pumping-mode of the reversible pump 10 (Quadrant 1, FIG. 3), where the check-valve equipped bypass 40*a* of $CBV_A$ allows pumped fluid from the reversible pump 10 to freely flow in an unthrottled manner to the extension side of the actuator, while the check-valve equipped bypass 40*b* of $CBV_B$ prevents the fluid exiting the retraction side of the actuator from bypassing $CBV_B$, which due to the pilot pressure provided from first main fluid line $L_A$ through cross pilot line 38*b* is opened initially into a throttling position, and eventually into a free-flowing state as the pilot pressure increases. During load-assisting extension of the actuator in a motoring-mode of the reversible pump (Quadrant 2, FIG. 3), where the check-valve equipped bypass 40*a* of $CBV_A$ allows output fluid from the motoring reversible pump 10 to again flow freely in an unthrottled manner to the extension side of the actuator, while the check-valve equipped bypass 40*b* of CBVs prevents the fluid exiting the retraction side of the actuator from bypassing $CBV_B$, which due to the pilot pressure in pilot path 36*b* is opened initially into a throttling position, and eventually into a free-flowing state as the pilot pressure increases.

During load-resisting retraction of the actuator in a pumping-mode of the reversible pump (Quadrant 3, FIG. 3), the check-valve equipped bypass 40*b* of CBVs allows pumped fluid from the reversible pump 10 to flow freely in an unthrottled manner to the retraction side of the actuator, while the check-valve equipped bypass 40*a* of $CBV_A$ prevents the fluid exiting the extension side of the actuator from bypassing $CBV_A$, which due to the pilot pressure in cross pilot line 38*a* is opened initially into a throttling position, and eventually into a free-flowing state as the pilot pressure increases. Finally, during load-assisting retraction of the actuator in a motoring-mode of the reversible pump (Quadrant 4, FIG. 3), the check-valve equipped bypass 40*b* of CBVs allows output fluid from the motoring reversible pump 10 to flow freely in an unthrottled manner to the retraction side of the actuator, while the check-valve equipped bypass 40*a* of $CBV_A$ prevents the fluid exiting the extension side of the actuator from bypassing $CBV_A$, which due to the pilot pressure in the pilot path 36*a* is opened initially into a throttling position, and eventually into a free-flowing state as the pilot pressure increases.

In addition to the described throttling at low loading conditions in each quadrant by one of the two CBVs, FIG. 8 employs the same use of two POCVs fed by a singular charge pressure to accommodate the differential flow across the actuator, as described above in relation to FIG. 1, unlike the FIG. 7 circuit which uses two different charge pressures for the respective POCVs to shift the critical loading zones to lower loading ranges. The charging system in FIG. 8 is denoted solely by accumulator 20, with the remainder of the charging system, including the charge pump 16, omitted for illustrative simplicity. The two CBVs are thus set such that the throttling occurs up to the upper limit of the unshifted critical zone, beyond which the CBV fully opens to a non-throttling condition.

FIG. 8A shows a variant of the FIG. 8 circuit, which employs the same use of two CBVs to perform select throttling only below the upper loading limits of the critical loading zones, but includes the FIG. 7 arrangement of two different charging pressures respectively applied to the two POCVs. This way, the shifting of the critical load value and surrounding critical loading zone to a lower range of load values means that the upper limit of the critical loading zone at which the CBV switches from throttled to unthrottled operation is lower, whereby throttling is performed over a lesser overall fraction of the total operating area, thus improving the efficiency of the circuit.

Figure 9A:
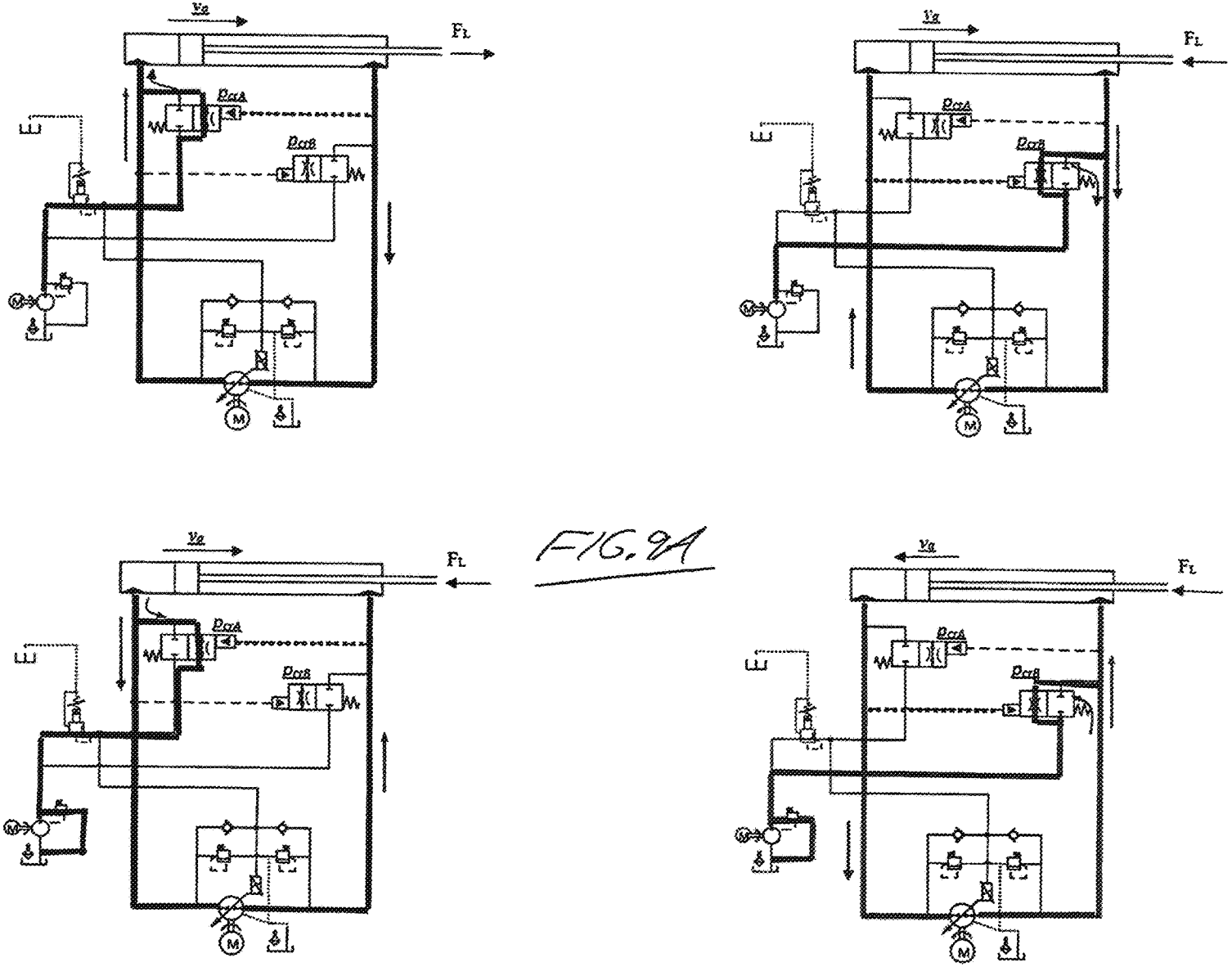

FIG. 9 shows a sixth embodiment circuit, which employs both concepts of centering the critical zones and throttling the flow only in the shifted critical zones. This embodiment replaces each POCV of the first embodiment with a respective 2-way single-pilot select-throttling valve 42*a*, 42*b* that serves both as a charging-control and vibration damping valve. Like the 2-way dual-pilot select-throttling valve of FIG. 7, each single-pilot throttling valve 42*a*, 42*b* has a controllable variable flow area that increases at a first rate during initial displacement, before increasing more rapidly under further displacement. However, displacement out of the normal default position is only possible in one direction. The first throttling valve 42*a* has a single pilot input 32*a* at one end thereof, actuation of which is resisted by a respective spring 34*a* at the opposing end thereof. The second throttling valve 42*b* likewise has a single pilot input 32*b* at one end thereof, actuation of which is resisted by a respective spring 34*b* at the opposing end thereof. The pilot input 32*a* of the first throttling valve 42*a* is fed by a cross-pilot line 26 from the second main fluid line $L_B$, while the pilot input 32*b* of the second throttling valve 42*b* is fed by a cross-pilot line 28 from the first main fluid line $L_A$. The first throttling valve 42*a* is connected between the first charging line 22 and the lower pressure side of the dual-pressure charging system 14', while the second throttling valve 42*b* is connected between the second charging line 24 and the higher pressure side of the dual-pressure charging system 14'. Each selective-throttling valve 42*a*, 42*b* is a normally closed valve that closes off the charging system from the respective charging line in the default valve position, but then initially throttles the fluid passing therethrough during the initial portion of its displacement due to the low flow-area opened therein, and then allows unthrottled flow during later stages of displacement due to the larger flow-area opened up therein. As with the other selective-throttling embodiments, each valve is set so that the free-flow state is achieved once the critical zone has been cleared, whereby throttling only occurs at low loading conditions below the upper limit of the critical zone, which is shifted toward center due to the use of two different charging pressures for the two valves 42*a*, 42*b*. This embodiment is more efficient than the fourth embodiment, as it only restricts the differential flow (i.e. the flow passing through the charging lines), which is only around 25% of the main flow. Consequently, this reduces the energy losses due to throttling, and reduces the number of components and complexity of the circuit required to accomplish both critical zone shifting and vibration damping within the shifted critical zone.

Figure 10:
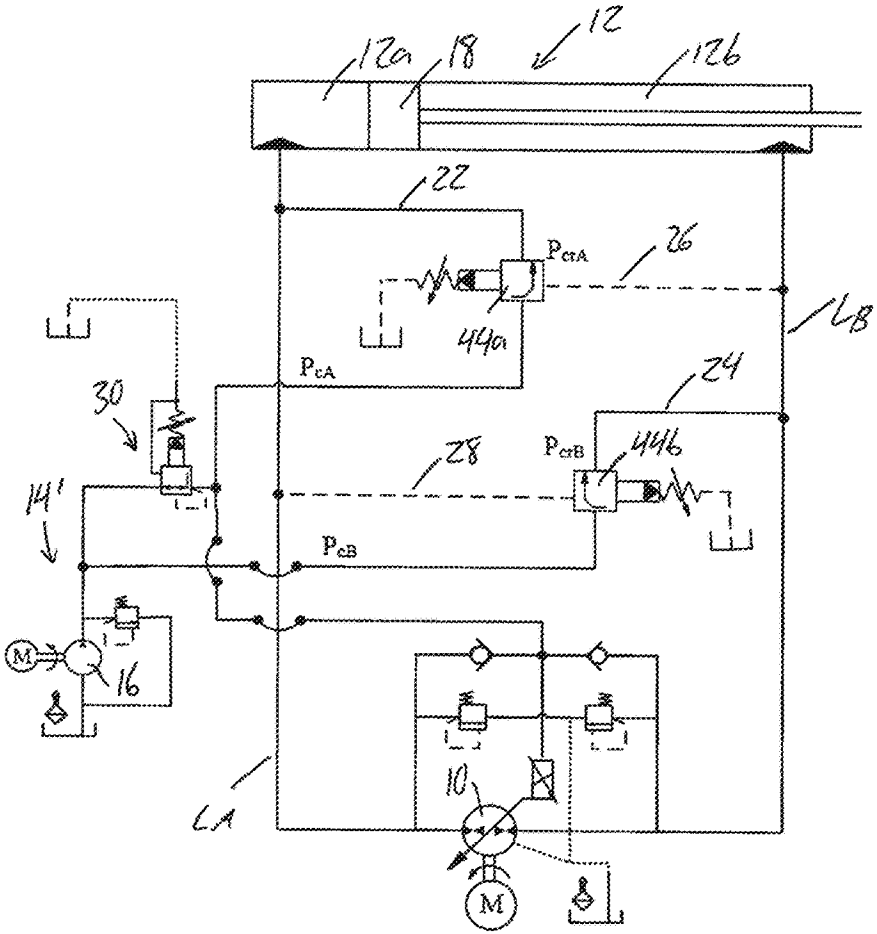
FIG. 10 schematically illustrates a seventh embodiment hydraulic circuit in which the pilot-operated selective-throttling valves of the sixth embodiment are replaced with sequence valves.
Figure 10A:
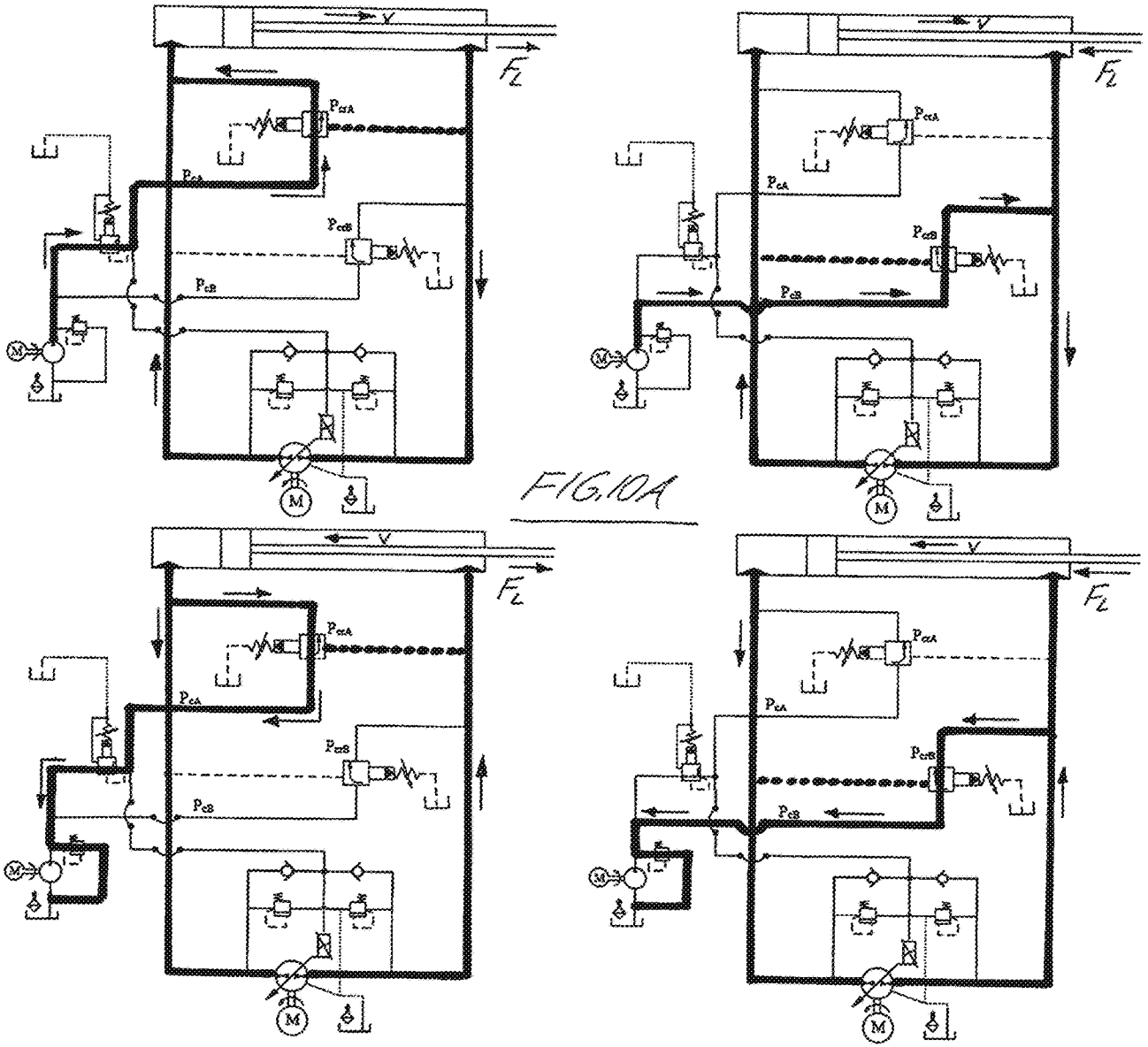
Figure 11A:
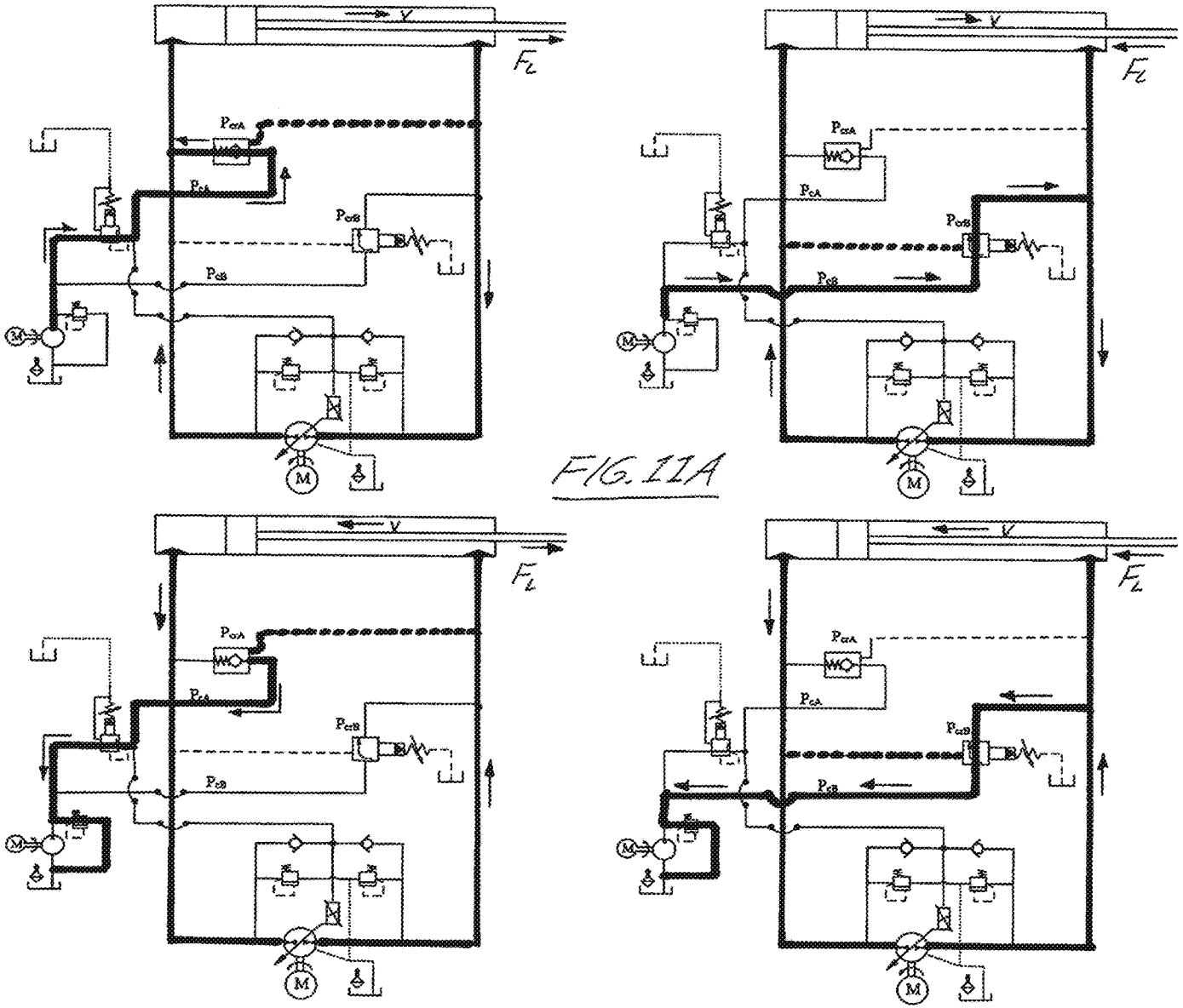

FIG. 10 shows a seventh embodiment that like the sixth embodiment accomplishes both critical zone shifting functionality and selective-throttling functionality within the shifted critical zones using only a single set of off-the-shelf valves, which in this case are sequence valves 44*a*, 44*b* that serve as both charge-control valves and vibration-damping valves. The first sequence valve 44*a* is operated by a first cross pilot line 26 connected to the second main fluid line $L_B$, while the second sequence valve 44*b* is operated by a second cross pilot line 28 connected to the first main fluid line $L_A$. The resulting effect is similar that of the sixth embodiment, wherein the normally closed sequence valve normally closes off the respective charging line from the charging system, and throttles the fluid only during an initial part of its opening stroke before fully opening its through-path to enable free unthrottled flow between the charging system and the respective charging line. Once again, only the differential flow in the charging lines is throttled, not the main flow in the main lines $L_A$, $L_B$.

Figure 11:
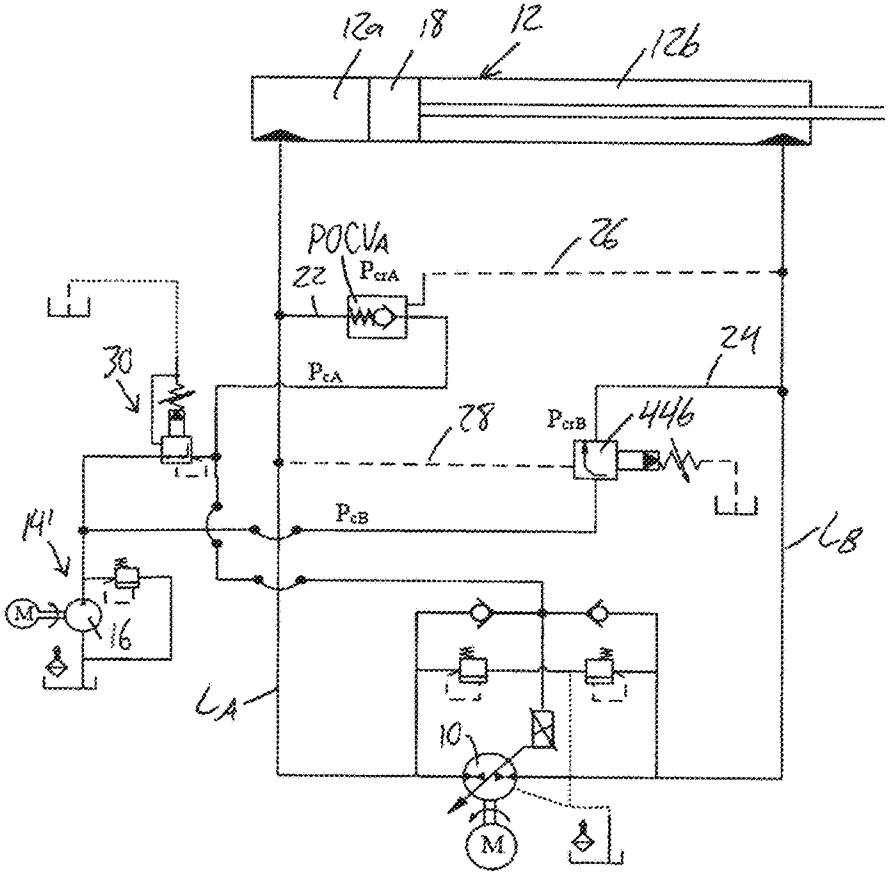
FIG. 11 schematically illustrates an eighth embodiment hydraulic circuit in which one of the sequence valves of the seventh embodiment is replaced with a pilot-operated check valve.

Finally, FIG. 11 shows an eight embodiment employing a singular pilot-operated check valve $POCV_A$ installed between the first charging line 22 and the lower pressure side of the of the dual-pressure charging system 14' to serve as one of the embodiments two charging control valves, and a singular sequence valve 44*b* between the second charging line 24 and the higher pressure side of the dual-pressure charging system 14' to serve as both the other charging-control valve and the vibration-damping valve. The POCV and the sequence valve 44*b* are respectively operated by cross pilot lines 26, 28, whereby the circuit once again provides both critical zone shifting and selective-throttling functionality.

Each of the forgoing embodiment uses valves that are exclusively pilot-operated (requiring no electronic monitoring and control components) not only to perform the acceptable switching necessary to accommodate differential flow to and from a single rod actuator (i.e. switching between a first circuit-charging state enabling flow through the first circuit-charging line between the first main fluid line and the charging circuit, and a second circuit-charging state enabling flow through the second circuit-charging line between the second main fluid line and the charging circuit), but also to use one or more varying characteristics (applied charge source, piston area, spring constant) between the two respective valve-actuating inputs such that the critical load value and associated range at which problematic operation would otherwise occur is shifted toward the center of the four quadrant operational map along the load force axis thereof. Select embodiments additionally or alternatively employ one or more valves in the main lines or charging lines that are again exclusively pilot-operated (requiring no electronic monitoring and control components) to provide selective throttling only below the upper limits of the critical loading zones, while allowing more efficient throttle-less flow in the larger operational areas outside the critical loading zones. In each case, four-quadrant operation is fully retained whereby motoring of the pump in two quadrants can be used for regeneration purposes for optimal efficiency.

Figure 12:
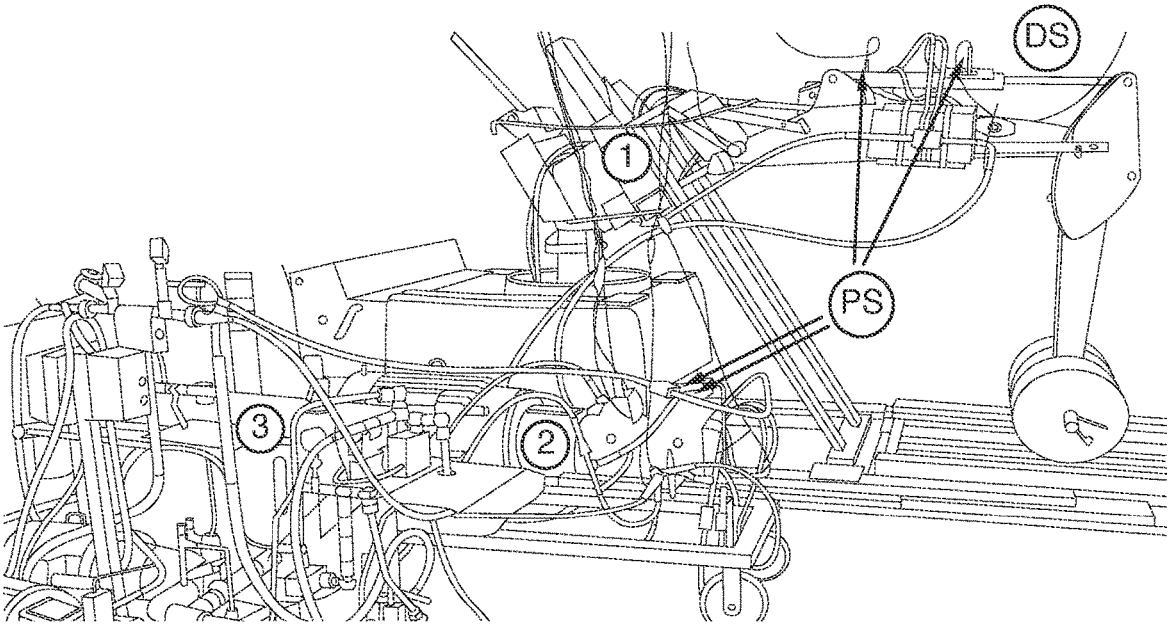
FIG. 12 shows a test rig used for experimentation testing of the second, fifth, seventh and eighth embodiments of FIGS. 5, 8, 10 and 11, including (1) JD-48 backhoe attachment, (2) main pump unit, (3) charge pump unit, (PS) pressure sensors, and (DS) displacement sensor.

FIG. 12 shows a test rig constructed for this study and its schematic drawing. The test rig was a John Deere backhoe attachment (JD-48) equipped with a variable displacement pump unit, a charge pressure unit and instrumentations. It was designed to facilitate the implementation of different hydraulic actuation circuits.

In testing the fifth embodiment circuit of FIG. 8, different loading conditions were applied to the stick actuator and responses were obtained at different velocities in each of the four quadrants. Experimental results showed good performance when pump runs only in single mode of operation away from the switching regions shown in FIG. 3.

Figure 13:
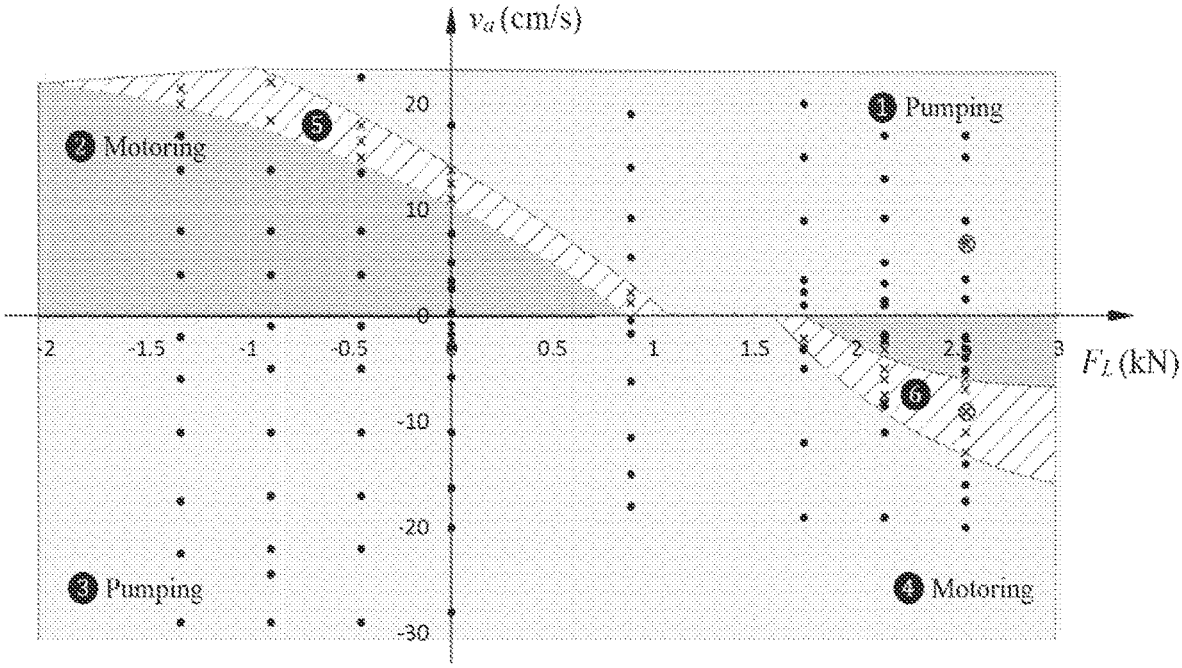
FIG. 13 shows experimental identification of critical zones (shown by hashed lines) given the prior art circuit of FIG. 1 utilizing POCVs.
Figure 14:
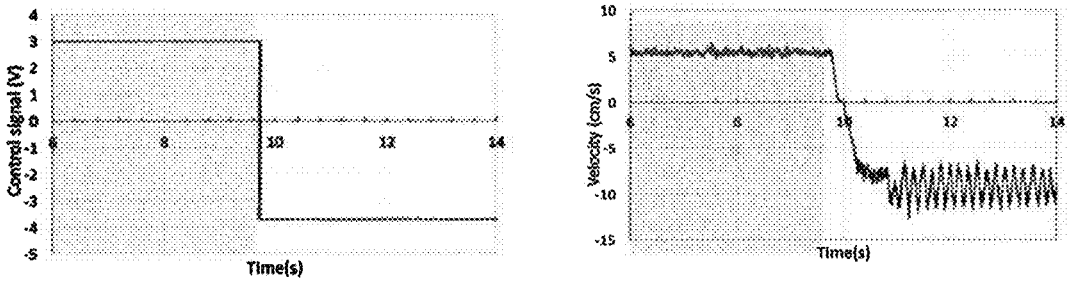
FIG. 14 shows typical performance results of the prior art shown in FIG. 1 circuit with POCVs only in extension and retraction at 2.54 kN external load (marked by distinguished points in FIG. 13), and more specifically shows the (a) control signal applied to pump swash plate system; (b) actuator velocity.

FIG. 13 shows the results categorized based on quality of performance and plotted on the $F_L$-$v_a$ plane. Each vertical set of points in the figure represents different actuator velocities for one load value. Areas hatched with dashed lines are regions where the pump switches mode of operation during actuator extension and retraction. Operation in these regions using the prior art exhibits deteriorated performance. FIG. 14 shows prior art circuit performance covering two regions. The experiment was done for a load of 2.54 kN during extension ($v_a$=5 cm/s) and retraction ($v_a$=−9 cm/s). As it is seen the second portion illustrates the circuit performance at oscillatory retraction. These experimental results validate the discussion presented in the earlier background.

Figure 15:
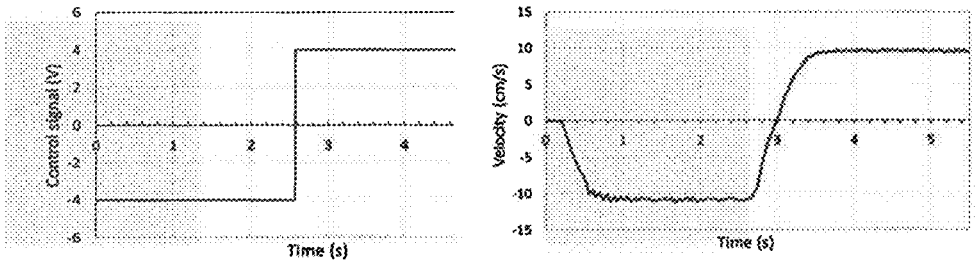
FIG. 15 shows performance of the FIG. 8 circuit at retraction and extension of 2.54 kN external load, and more specifically shows the: (a) control signal: and (b) actuator velocity.

A first experiment using the FIG. 8 circuit was designed to demonstrate performance improvements at low loading conditions. A second set of tests was performed to show the circuit performance and energy consumption during operation spanning all four quadrants. FIG. 15 shows the performance in a typical retraction—extension of actuator with constant load (similar to test shown in FIG. 14). Actuator velocity and pressure graphs show that the circuit response is non-oscillatory.

In the second set of experiments, the load of 0.4 kN was applied to the full setup shown in FIG. 12. The experiments were repeated for both the inventive FIG. 8 circuit and the prior art FIG. 1 circuit that utilizes the POCVs. The wave square control signal input (FIG. 16) was applied to the pump to move the stick link carrying the external load of 0.4 kN.

Figure 17:
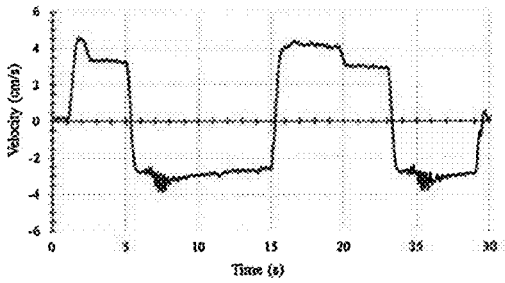
FIG. 17 shows the actuator velocity performance of the FIG. 1 circuit utilizing only POCVs at 4 quadrants of operation and 0.4 kN external load.
Figure 18:
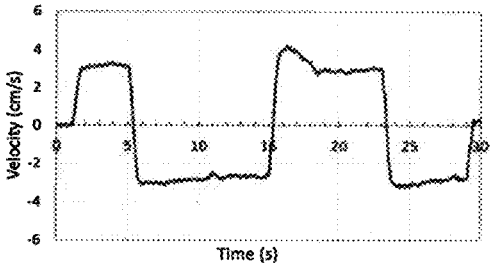
FIG. 18 shows the actuator velocity performance of the FIG. 8 circuit at 4 quadrants of operation and 0.4 kN external load.
Figure 19:
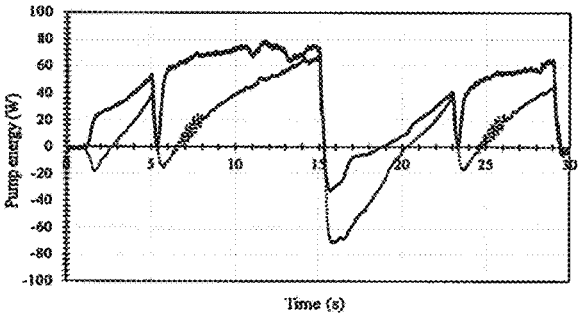
FIG. 19 shows energy delivered/received by main pump in the FIG. 1 circuit that utilizes only POCVs (dotted line) and the FIG. 8 circuit (solid line).

Results for both circuits are shown in FIGS. 17 to 19. It is clear that the prior art FIG. 1 circuit with the POCVs exhibits oscillation during switching from assistive to resistive loading modes in actuator retraction. The oscillatory response is shown clearly in velocity plot. Results also show that performance of the proposed circuit is smooth without any significant oscillation during switching modes.

The inventive FIG. 8 circuit, however, consumes more energy than the prior art FIG. 1 circuit with only POCVs as shown in FIG. 19. The delivered hydraulic energy from the pump to the circuit is calculated as the multiplication of pressure differential across the pump by the flow rate, $W_{pmh}=(p_a-p_b)Q$. Q was calculated by multiplying the actuator measured velocity and the piston effective area. Results showed that both circuits consume energy when load is resistive and recuperate energy when load is assistive. For this experiment, the average delivered hydraulic energy from the pump to the circuit was 17.1 W for the prior art FIG. 1 circuit that utilizes only POCVs and was 36 W for the inventive FIG. 8 circuit. The average received (recuperated) hydraulic energy from the circuit to the pump are 7.2 W and 2.9 W for the prior art FIG. 1 circuit that utilizes only POCVs and the inventive FIG. 8 circuit, respectively. The extra energy consumed by the inventive FIG. 8 circuit was used to overcome the hydraulic resistance generated by the CBVs to stabilize the system. Note that, the extra needed energy reduces as the load increases.

Figure 16:
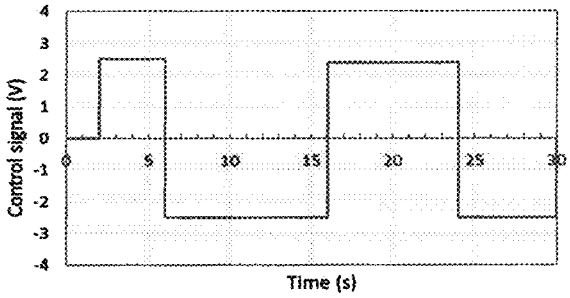
FIG. 16 shows the control signal applied for experimental evaluation of the FIG. 8 circuit compared to performance of FIG. 1 circuit.

Comparison was also made of the energy consumed by the inventive FIG. 8 circuit to a valve-controlled circuit. Considering a valve-controlled hydraulic system is equipped with a pressure compensated pump, the pump energy consumption equals to the nominal pump pressure multiplied by the flow rate. Knowing that the maximum pressure value in the experiment shown in FIGS. 16, 17 and 18 is 8 MPa, the pump nominal pressure was set in the valve-controlled circuit at 8 MPa. The average consumed hydraulic energy by the pump in a valve-controlled circuit performing the same task as in FIG. 19 is 1081.8 W. Thus the inventive FIG. 8 circuit consumed only 8.9% of energy needed by a comparable valve-controlled circuit to deliver the same amount of hydraulic energy to the actuator, and at the same time produces a performance better than at least the prior art of FIG. 1.

Since various modifications can be made in the invention as herein above described, and many apparently widely different embodiments of same made within the scope of the claims without departure from such scope, it is intended that all matter contained in the accompanying specification shall be interpreted as illustrative only and not in a limiting sense.

REFERENCES

Each of the cited documents below is incorporated herein by reference in its entirety.

1. Cleasby, K. G.; Plummer, A. R. A novel high efficiency electrohydrostatic flight simulator motion system. *Sym-*

*posium on Fluid Power and Motion Control* (*FPMC* 2008), Bath, UK, 2008; pp 437-449.

2. Aly, A. A.; Salem, f. A.; Hanafy, T. O. Energy Saving Strategies of an Efficient Electro-Hydraulic Circuit (A review). *International Journal of Control, Automation and Systems* 2014, 3 (3), 6-10.
3. Hansen, R. H.; Andersen, T. O.; Pedersen, H. C. Development and Implementation of an Advanced Power Management Algorithm for Electronic Load Sensing on a Telehandler. *ASME/BATH Symposiom on Fluid Power and Motion Control*, Bath, UK, 2010.
4. Eriksson, B. *Mobile Fluid Power Systems Design with a Focus on Energy Efficiency*; PhD Thesis, Linköping University: Sweden, 2010.
5. Zimmerman, J.; Pelosi, M.; Williamson, C.; Ivantysynova, M. Energy Consumption of an LS Excavator Hydraulic System. 2007 *ASME International Mechanical Engineering Congress and Exposition*, Seattle, Wash., USA, Nov. 11-15, 2007.
6. Jalayeri, E.; Imam, A.; Sepehri, N. A Throttle-less Single Rod Hydraulic Cylinder Positioning System for Switching Loads. *Case Studies in Mechanical Systems and Signal Processing* http://dx.doi.org/10.1016/j.csmssp.2015.06.001.
7. Li, J.; Fu, Y.; Wang, Z.; Zhang, G. Research on fast response and high accuracy control of an airborne electro hydrostatic actuation system. 2004 *International Conference on Intelligence, Mechatronics and Automotion*, Changdu, China, 2004.
8. Quan, Z.; Quan, L.; Zhang, J. Review of energy efficient direct pump controlled cylinder electro-hydraulictechnology. *Renewable and Sustainable Energy Reviews* 2014, 35, 336-346.
9. Bossche, D. The A380 flight control electrohydrostatic actuators, achievements and lessons learnt. 25*th International Congress of Aeronautical sciences*, Hamburg, Germany, 2006.
10. Hewett, A. Hydraulic circuit flow control. U.S. Pat. No. 5,329,767, Jul. 19, 1994.
11. Rahmfeld, R.; Ivantysynova, M. Displacement of controlled linear actuator with differential cylinder—a way to save primary energy in mobile machines. *Fifth International Conference on Fluid Power Transmission and Control*, Hangzhou, China, 2001.
12. Wang, L.; Book, W. J.; Huggins, J. D. A hydraulic circuit for single rod cylinder. *Journal of Dynamic Systems, Measurement, and Control, ASME* 2012, 134(1), 011019-011-16.
13. Calishan, H.; Balkan, T.; Platin, E. B. A Complete Analysis and a Novel Solution for Instability in Pump Controlled Asymmetric Actuators. *Journal of Dynamic Systems, Measurement, and Control* 2015, 137 (1), 091008-091-14.
14. Heybroek, K.; Palmberg, J.-O.; Lillemets, J.; Lugnberg, M.; Ousback, M. Evaluating a Pump Controlled Open Circuit Solution. 51*st National Conference on Fluid Power*, Las Vegas, Nev., USA, 2008.
15. Altare, G.; Vacca, A. Design solution for efficient and compact electro-hydraulic Actuators. *Dynamics and Vibroacoustics of Machines* (*DVM*2014), Samara, Russia, 2014.
16. Ivantysynova, M. Displacement controlled actuator technology—Future for fluid power in aircraft and other applications. 3*rd International Fluid Power Conference*, Aachen, Germeny, 2002.
17. Hippalgaonkar, R.; Ivantysynova, M. A Series-Parallel Hydraulic Hybrid Mini-Excavator with Displacement Controlled Actuators. *The* 13*th Scandinavian International Conference on Fluid Power, SICFP*2013, Linköping, Sweden, 2013.
18. Grabbel, J.; Ivantysynova, M. Model adaptation for robust control design of hydraulic joint servo actuators. 4*th International Symposium on Fluid Power Transmission and Control* (*ICFP* 2003), pp. 16-24, Wuhan, China, 2003.
19. Williamson, C.; Ivantysynova, M. Stability and motion control of inertial loads with displacement controlled hydraulic actuators. 6*th FPNI-PhD Symposium,* 499-514, West Lafayette, USA, 2010.
20. Williamson, C.; Ivantysynova, M. Pump Mode Prediction for Fourquadrant Velocity Control of Valveless Hydraulic Actuators. 7*th JFPS International Symposium on Fluid Power*, Toyama, Japan, 2008; pp 323-328.
21. Williamson, C. *Power Management for Multi-Actuator Mobile Machines with Displacement Controlled Hydraulic*; PhD Thesis, University of Purdue: West lafayette, Ind., USA, 2010.
22. Zimmerman, J. D. *Toward Optimal Multi-actuator Displacement Controlled Mobile Hydraulic Systems*; Purdue University: West Lafayette, Ind., United States, 2012.
23. Sauer-Danfoss Technical Team. *Series* 42 *Axial Piston Pumps Technical Information*: Sauer-Danfoss Corp.: Ames, USA.
24. Jalayeri, E.; Imam, A.; Zeljko, T.; Sepehri, N. A throttle-less single-rod hydraulic cylinder positioning system: Design and experimental evaluation. *Advances in Mechanical Engineering* 2015, 7 (5), 1-14.
25. Michel, S.; Weber, J. Energy efficient electrohydraulic compact drives for low power applications. *ASME/BATH Symposium on Fluid Power and Motion Control,* 93-107, 2012.
26. MathWorks. http://www.mathworks.com/help/physmod/hydro/ref/cylinderfriction.html (accessed Jul. 25, 2016).
27. Zhang, J.; Chen, S. Modelling and study of active vibration control for off road vehicle. *Vehicle System Dynamics* 2013, 52 (5), 581-607.
28. Eaton http://www.eaton.com/ecm/groups/public/@pub/@eaton/@hyd/documents/content/pct_273380.pdf (accessed Jun. 1, 2016).
29. Altare, G.; Vacca, A.; Richter, C. A Novel Pump Design for an Efficient and Compact Electra-Hydraulic Actuator. *IEEE Aerospace Conference*, Samara, Russia, 2014.

The invention claimed is:

1. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator, said charging system having two different outlets respectively providing higher and lower pressure supplies of charging fluid;

first and second charging lines respectively connecting the charging system to the first and second main fluid lines, and each being connected to a different one of said two different outlets of the charging system; and at least one charging-control valve (32', or $p_{crA}$ & $p_{crB}$) operably installed in the first and/or second charging lines and operable to switch between at least a first charging fluid supply/release state enabling flow through the first charging line between the first main fluid line and the charging circuit, and a second charging fluid supply/release state enabling flow through the second charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein said at least one charging-control valve comprises first and second charging control valves ($p_{crA}$ & $p_{crB}$), at least one of which is further configured to also operate as pilot-operated vibration-damping valve (42*a*, 42*b*, 44*a*, 44*b*) configured to throttle flow in the hydraulic circuit in a critical loading zone of the four-quadrant mode of operation, while allowing unthrottled flow in the hydraulic circuit outside the critical loading zone.

2. The hydraulic circuit of claim 1 wherein a higher pressure one of said two different outlets of the charging system is connected to the second charging line to connect the higher pressure supply of charging fluid to the second main fluid line in the second charging fluid supply/release state of the at least one charging control valve.

3. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator, said charging system having two different outlets respectively providing higher and lower pressure supplies of charging fluid;

first and second charging lines respectively connecting the charging system to the first and second main fluid lines, and each being connected to a different one of said two different outlets of the charging system; and at least one charging-control valve (32', or $p_{crA}$ & $p_{crB}$) operably installed in the first and/or second charging lines and operable to switch between at least a first charging fluid supply/release state enabling flow through the first charging line between the first main fluid line and the charging circuit, and a second charging fluid supply/release state enabling flow through the second charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein the hydraulic charging system comprises a charging pump, and a pressure reducer connected between the charging pump and the first fluid charging line to define a lower pressure one of said two different outputs of the charging system, the first charging line being connected to said lower pressure one of said two different outputs to connect the lower pressure supply of charging fluid to the first main fluid line in the first charging fluid supply/release state of the first and second charging control valves.

4. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator;

a first charging line connecting the charging circuit to the first main fluid line;

a second charging line connecting the charging circuit to the second main fluid line; and at least one charging-control valve operably installed in the first and/or second charging lines and operable to switch between at least a first charging fluid supply/release state enabling flow through the first circuit-charging line between the first main fluid line and the charging circuit, and a second charging fluid supply/release state enabling flow through the second circuit-charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein the at least one charging-control valve comprises first and second pilot-operated charging-control valves ($POCV_A$ & $POCV_B$) respectively installed in the first and second charging lines, with a pilot of the first pilot-operated charging-control valve connected to the second main fluid line and a pilot of the second pilot-operated charging-control valve connected to the first main fluid line, and the hydraulic circuit further comprises a first and second pilot-operated vibration damping valves ($CBV_A$, $CBV_B$) respectively installed in the first and second main lines between the first and second pilot-operated charging-control valves and the differential hydraulic actuator, and configured to throttle fluid during low loading conditions of the differential hydraulic actuator, and to freely pass fluid in an unthrottled manner during higher loading conditions of the differential hydraulic actuator.

5. The hydraulic circuit of claim 4 wherein said pilot-operated vibration damping valves ($CBV_A$, $CBV_B$) comprise pilot-operated counterbalance valves ($CBV_A$ $CBV_A$), with a pilot of the first pilot-operated counterbalance valve connected to the second main fluid line and a pilot of the second pilot-operated counterbalance valve connected to the first main fluid line.

6. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator, said charging system having two different outlets respectively providing higher and lower pressure supplies of charging fluid;

first and second charging lines respectively connecting the charging system to the first and second main fluid lines, and each being connected to a different one of said two different outlets of the charging system; and at least one charging-control valve (32', or $p_{crA}$ & $p_{crB}$), operably installed in the first and/or second charging lines and operable to switch between at least a first charging fluid supply/release state enabling flow through the first charging line between the first main fluid line and the charging circuit, and a second charging fluid supply/release state enabling flow through the second charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein the at least one charging-control valve comprises a charging-control valve (32') having first and second piston areas for driving of said charging-control valve in opposing directions using fluid from opposing ones of said main fluid lines and resisted by first and second springs, and wherein said first and second piston areas differ from one another in size, and/or said first and second springs have different spring constants.

7. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator, said charging system having two different outlets respectively providing higher and lower pressure supplies of charging fluid;

first and second charging lines respectively connecting the charging system to the first and second main fluid lines, and each being connected to a different one of said two different outlets of the charging system; and at least one charging-control valve (32', or $p_{crA}$ & $p_{crB}$), operably installed in the first and/or second charging lines and operable to switch between at least a first charging fluid supply/release state enabling flow through the first charging line between the first main fluid line and the charging circuit, and a second charging fluid supply/release state enabling flow through the second charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein the at least one charging-control valve comprises a shuttle valve (32') having a center position presenting closure or throttling points between the first and second charging lines and two differently pressured outlets of the charging system, a first shifted position opening the first charging line to the charging system and closing the second charging line from the charging system to define the first charging fluid supply/release state, and a second shifted position opening the second charging line to the charging system and closing the first charging line from the charging system to define the second charging fluid supply/release state.

8. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator, said charging system having two different outlets respectively providing higher and lower pressure supplies of charging fluid;

first and second charging lines respectively connecting the charging system to the first and second main fluid lines, and each being connected to a different one of said two different outlets of the charging system; and at least one charging-control valve (32', or $p_{crA}$ & $p_{crB}$), operably installed in the first and/or second charging lines and operable to switch between at least a first charging fluid supply/release state enabling flow through the first charging line between the first main fluid line and the charging circuit, and a second charging fluid supply/release state enabling flow through the second charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant;

wherein the at least one charging-control valve comprises a shuttle valve (32') having a center position closing or throttling both the first and second charging lines, a first shifted position opening the first charging line to the charging system and closing the second charging line from the charging system to define the first charging fluid supply/release state, a second shifted position opening the second charging line to the charging system and closing the first charging line from the charging system to define the second charging fluid supply/release state, first and second piston areas arranged to shift the valve into the first and second shifted positions respectively when acted upon by sufficient fluid pressure, and first and second springs respectively resisting movement into the first and second shifted positions, wherein the piston areas differ from one another in size and/or the springs differ from one another in stiffness.

9. The hydraulic circuit of claim 8 wherein the shuttle valve (32') closes the first and second charging lines in the center position.

10. The hydraulic circuit of claim 8 wherein the shuttle valve (32') throttles the first and second charging lines in the center position.

11. A pump-controlled hydraulic circuit for operating a differential hydraulic actuator, said circuit comprising:

a reversible hydraulic pump;

a first main fluid line connecting a first side of the reversible hydraulic pump to an extension side of the differential hydraulic actuator;

a second main fluid line connecting a second side of the reversible hydraulic pump to a retraction side of the differential hydraulic actuator;

a hydraulic charging system for supplying/releasing charging fluid to and from the first and second main fluid lines to compensate for differential flow on opposing sides of the differential hydraulic actuator, said charging system having two different outlets respectively providing higher and lower pressure supplies of charging fluid;

first and second charging lines respectively connecting the charging system to the first and second main fluid lines, and each being connected to a different one of said two different outlets of the charging system;

at least one charging-control valve (32', or $p_{crA}$ & $p_{crB}$), operably installed in the first and/or second charging lines and operable to switch between at least a first charging fluid supply/release state enabling flow through the first charging line between the first main fluid line and the charging circuit, and a second charging fluid supply/release state enabling flow through the second charging line between the second main fluid line and the charging circuit, thereby enabling supply and release of the charging fluid to and from the first and second main fluid lines, whereby the reversible hydraulic pump cooperates with the differential hydraulic cylinder via the main charging lines, the charging lines and the charging system to operate to provide a four quadrant mode operation including a first load-resistive actuator-extension quadrant, a second load-assistive actuator-extension quadrant, a third load-resistive actuator-retraction quadrant and a fourth load-assistive actuator-retraction quadrant; and further comprising one or more pilot-operated vibration-damping valves (32", or $CBV_A$ & $CBV_B$), wherein the at least one charging-control valve comprises first and second charging control valves ($p_{crA}$ & $p_{crB}$), and the one or more pilot-operated vibration-damping valves are installed in one or both of the main lines at one or more locations between the first and second charging control valves and the differential hydraulic actuator, and are configured to throttle fluid during low loading conditions of the differential hydraulic actuator, and to freely pass fluid in an unthrottled manner during higher loading conditions of the differential hydraulic actuator.

12. The hydraulic circuit of claim 11 wherein the one or more vibration-damping valves comprise one or more variable flow area valves (32", $CBV_A$, $CBV_B$) each having a variable and controllable flow area, and arranged to maintain a smaller flow area during the low loading conditions before enlarging the flow area for the higher loading conditions.

13. The hydraulic circuit of claim 11 wherein the one or more vibration-damping valves comprise first and second pilot-operated counterbalance valves ($CBV_A$ $CBV_A$) respectively installed in the first and second main fluid lines, with a pilot of the first pilot-operated counterbalance valve connected to the second main fluid line and a pilot of the second pilot-operated counterbalance valve connected to the first main fluid line.

* * * * *